US010724179B2

(12) United States Patent
Johansson

(10) Patent No.: US 10,724,179 B2
(45) Date of Patent: Jul. 28, 2020

(54) RAILWAY SWITCH MECHANISM AND METHOD FOR OPERATING A RAILWAY SWITCH MECHANISM

(71) Applicant: VE'RTEX SWEDEN AB, Tollered (SE)

(72) Inventor: Bo Johansson, Tollered (SE)

(73) Assignee: VE'RTEX SWEDEN AB, Tollered (SE)

( * ) Notice: Subject to any disclaimer, the term of this patent is extended or adjusted under 35 U.S.C. 154(b) by 484 days.

(21) Appl. No.: 15/559,023

(22) PCT Filed: Mar. 16, 2016

(86) PCT No.: PCT/SE2016/050213
§ 371 (c)(1),
(2) Date: Sep. 15, 2017

(87) PCT Pub. No.: WO2016/148631
PCT Pub. Date: Sep. 22, 2016

(65) Prior Publication Data

US 2018/0100273 A1 Apr. 12, 2018

(30) Foreign Application Priority Data

Mar. 16, 2015 (SE) ..... 1550313

(51) Int. Cl.
*E01B 7/08* (2006.01)
*B61L 5/02* (2006.01)
(Continued)

(52) U.S. Cl.
CPC ..... *E01B 7/08* (2013.01); *B61L 5/02* (2013.01); *E01B 7/24* (2013.01); *E01B 7/14* (2013.01); *E01B 2202/028* (2013.01)

(58) Field of Classification Search
CPC ..... E01B 7/00; E01B 7/02; E01B 7/04; E01B 7/06; E01B 7/08; E01B 7/10; E01B 7/14; B61L 5/02
See application file for complete search history.

(56) References Cited

U.S. PATENT DOCUMENTS 591,051 A * 10/1897 McCully ..... E01B 7/14 246/382
792,646 A * 6/1905 Byron ..... E01B 7/08 246/433
(Continued)

FOREIGN PATENT DOCUMENTS

CN 2161636 Y 4/1994
CN 202543738 U 11/2012
(Continued)

OTHER PUBLICATIONS

Decision on Grant received in corresponding Russian Patent Application No. 2017135078, dated Sep. 3, 2019.
(Continued)

*Primary Examiner* — Jason C Smith
(74) *Attorney, Agent, or Firm* — Marshall, Gerstein & Borun LLP

(57) ABSTRACT

A railway switch mechanism including first and second switch blades, wherein a switch point of each of the first and the second switch blades is vertically displaceable by means of a displacement mechanism in order to establish a switch movement in the respective switch point, wherein the respective displacement mechanism includes at least one pair of cooperating wedges having a lower wedge and an upper wedge, wherein at least one wedge of the at least one pair of cooperating wedges is arranged to be displaced in a direction substantially parallel to a longitudinal direction of the switch blade or parallel with a longitudinal direction of the switch mechanism, and wherein the switch blades are
(Continued)

elastically deformable in the vertical direction or pivotally connected by hinged joints to first and second closure rails respectively for enabling the vertical displacement of the switch blades.

40 Claims, 10 Drawing Sheets

(51) Int. Cl.
*E01B 7/24* (2006.01)
*E01B 7/14* (2006.01)

(56) References Cited

U.S. PATENT DOCUMENTS 1,399,914 A * 12/1921 Alonzo ..... E01B 7/08 246/433
3,591,799 A * 7/1971 Lica ..... E01B 7/08 246/433
3,977,635 A * 8/1976 Pirker ..... B61L 5/02 246/387
4,251,042 A * 2/1981 Frank ..... E01B 7/04 246/442
5,292,091 A * 3/1994 Callegari ..... B61L 5/10 246/258
8,157,221 B2 * 4/2012 Landow ..... E01B 7/00 246/433
2016/0319491 A1 * 11/2016 Bemment ..... B61L 5/02
2018/0100273 A1 * 4/2018 Johansson ..... E01B 7/08

FOREIGN PATENT DOCUMENTS

CN 102979011 A 3/2013
CN 103696331 A 4/2014
EP 0315621 A2 5/1989
EP 0455207 A1 11/1991
SU 1194939 A1 11/1985

OTHER PUBLICATIONS

Chinese Office Action received for Chinese Patent Application No. 20168002804.0, dated Oct. 25, 2018.
International Search Report and Written Opinion for PCT/SE2016/050213, dated Jun. 16, 2016.
International Search Report and Written Opinion for Application No. PCT/SE2016050213 dated May 10, 2019.

* cited by examiner

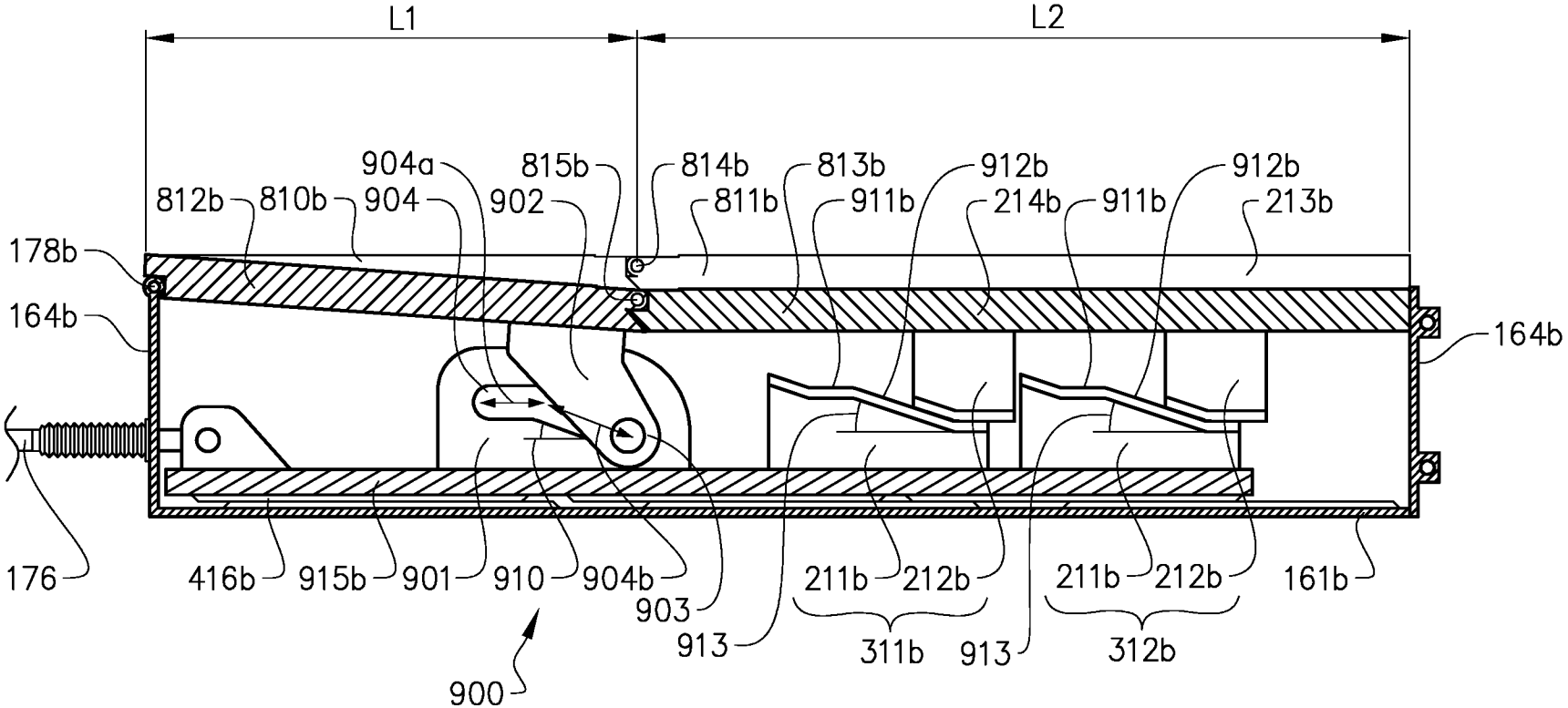
FIG. 9a F-F

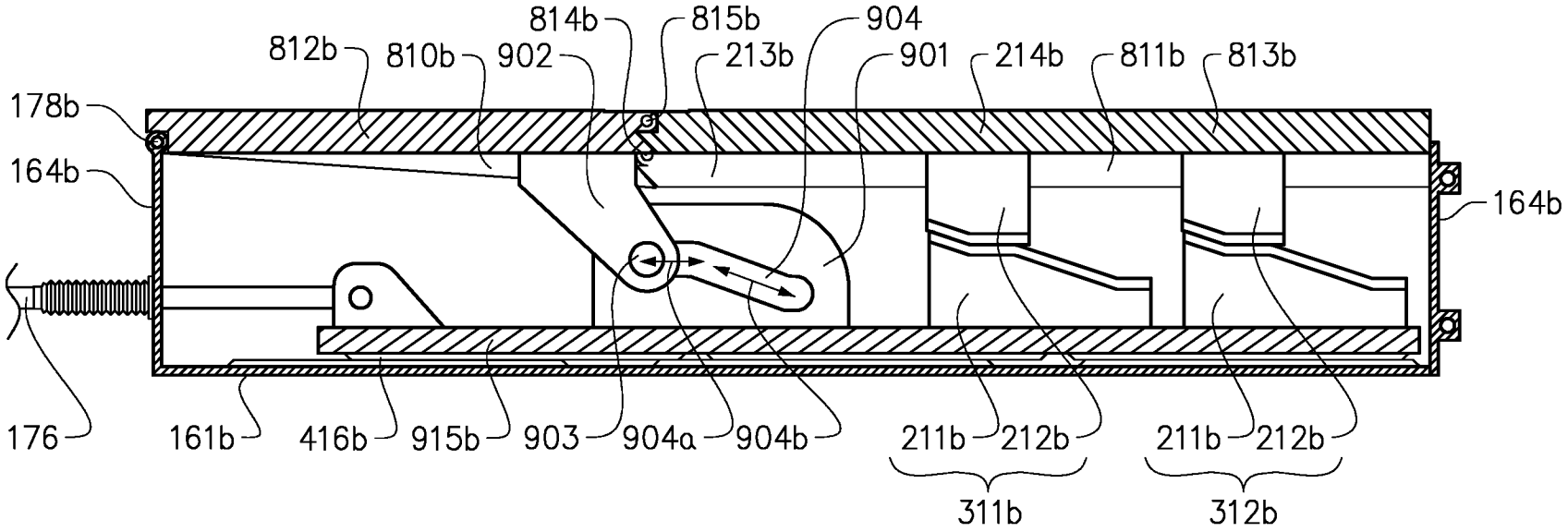
FIG. 9b F-F

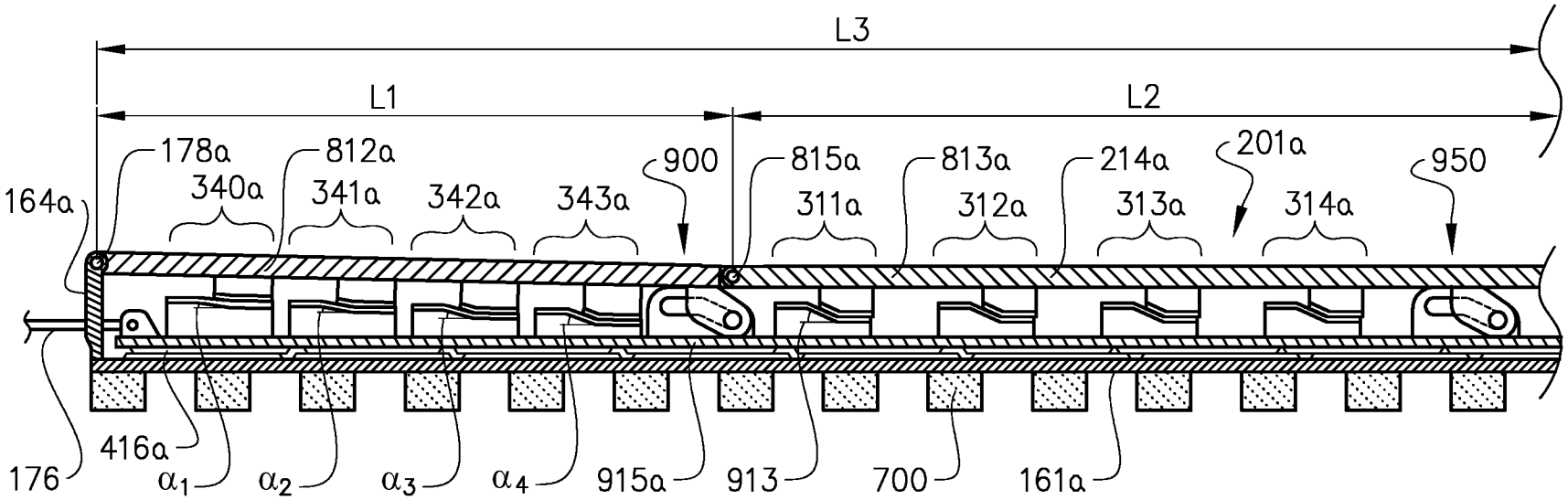
FIG. 10 E-E

RAILWAY SWITCH MECHANISM AND METHOD FOR OPERATING A RAILWAY SWITCH MECHANISM

TECHNICAL FIELD

This disclosure relates to a railway switch mechanism comprising a first and a second switch blade and a switch frog. The disclosure also relates to a method for operating railway switch mechanism having first and a second switch blades and a switch frog, a railway switch mechanism comprising a switch frog, and a railway switch mechanism comprising a first and a second switch blade. The railway switch mechanism may typically be used for enabling switching from following a main railway route to or from a railway diverging route or opposite.

BACKGROUND

It is commonly known that railway switches have problems with reliability when operating in winter conditions due to snow and ice preventing correct switching of the switch blades. Snow and ice may block proper switching motion of the switch blades, such that railway service personnel may have to be requested for servicing. One known attempt for reducing the problems of blocking due to snow and ice is electrical heating of the railway switch. Electrical heating is however costly due to the significant amount of electrical energy required for heating. There is thus a need for an improved railway switch removing the above mentioned disadvantages.

SUMMARY

An object of the present disclosure is to provide a railway switch mechanism where the previously mentioned problem is at least partly avoided. This object is achieved by the features of the independent claims.

The problem of unreliable switching during winter condition is primarily caused by the fact that snow and ice easily get clamped between stock rails and switch blades upon horizontal motion of the switch blades. There is simply no effective means available for avoiding the clamping of the snow and ice during horizontal switching motion. Similar problems may occur due when debris, stones or other particles are getting clamped by the horizontally moving switch blades. The solution provided by the invention is based on using vertical switching motion of the switch blades instead.

By adopting a vertical switching motion the risk for clamping snow and ice between the switch blades and another component of the switch mechanism is significantly reduced. There horizontal space between the switch blade and stock rails is substantially identical in both switching positions of the switch blades, such that substantially no snow and ice can enter this space at any time. Furthermore, even if any snow or ice would become located in the region of the switch blades, the likelihood that said snow and ice will cause any substantial harm is low because there is plenty of opportunity for any snow or ice to be pushed away during switching motion without becoming clamped between two parts such as to negatively influence the reliability or functionality of the switch.

A switch frog as such improves the safety, functionality and passenger comfort by means of eliminating or at least reducing the gap that exists in fixed stationary frogs. The gap is necessary for enabling the flange of each wheel to pass the frog in each travelling direction of the frog. A wheel passing a stationary frog thus generally temporarily lack proper lateral support, and the wheel will typically descend a certain distance into the gap before hitting the continuing rail path on the other side of the gap, such to induce a shock and generate noise. A switch frog, i.e. a frog than can selectively fill the gaps between a frog point and associated closure tracks by means of switching at least one switching element, reduces or substantially eliminates those problems. Known solutions for switch frogs rely on switching a rail segment moving in the horizontal direction, such as for example a swingnose crossing. However, this type of switch frogs experience the same problems as discussed above in relation to switch blades, namely blocking of proper switching motion of the switching rail segments by snow and ice. The solution defined by the independent claims, namely to use vertically moving switching rail segments in the switch frog, provide essentially the same advantages for the switch frog as described in relation to the switch blades.

Blocking of a vertical switching motion by snow and ice is much more difficult than blocking of a horizontal switching motion due to the lack of opposing surfaces that approaches each other during switching motion. In horizontal switching motion a side surface of the switch blade is located opposite and facing a side surface of the stock rail, and said side surfaces are approaching or retreating from each other during switching motion. In vertical raising switching motion however, no surface is available vertically above the switch blade or switch frog rail segment, such that essentially no blocking can occur. Moreover, in vertical lowering switching motion of the switch blades or switch frog rail segments, it is a theoretical possibility that snow and ice may get trapped at an underside of the switch blade or rail switch frog segment, but this may be avoided by providing sufficient vertical space underneath the switch blades and switch frog rail segments. The space underneath a vertically moveable switch blade or switch frog rail segment may also be better protected and sealed from entering snow and ice compared with a conventional railroad switch mechanism having horizontal switching motion.

According to a first aspect of the invention, the object is at least partly achieved by a railway switch mechanism comprising a first and a second switch blade, wherein a switch point of each of the first and the second switch blade is vertically displaceable by means of a displacement mechanism in order to establish a switch movement in the respective switch point, wherein the respective displacement mechanism comprises at least one pair of cooperating wedges having a lower wedge and an upper wedge, and wherein at least one wedge of the at least one pair of cooperating wedges is arranged to be displaced in a direction substantially parallel to a longitudinal direction of the switch blade or parallel with a longitudinal direction of the switch mechanism, wherein the switch blades are elastically deformable in the vertical direction or pivotally connected by hinged joints to first and second closure rails respectively for enabling the vertical displacement of the switch blades.

According to a second aspect of the invention, the object is at least partly achieved by a railway switch mechanism comprising a switch frog, wherein the switch frog comprises first and second vertically displaceable rail segments in order to establish a switch movement at the switch frog, wherein each switch frog rail segment is provided with a respective displacement mechanism by means of which at least a portion of the first and second switch frog rail segments can be displaced in a vertical direction to at least an upper and a lower position, wherein each respective displacement mechanism comprises at least one pair of cooperating wedges having a lower wedge and an upper wedge, wherein the at least one wedge of the at least one pair of cooperating wedges is arranged to be displaced in a longitudinal direction of the switch mechanism, or in a direction substantially parallel to a longitudinal direction of the switch frog rail segment, respectively.

According to a third aspect of the invention, the object is at least partly achieved by a railway switch mechanism comprising first and second switch blades and a switch frog, wherein a switch point of each of the first and the second switch blade is vertically displaceable in order to establish a switch movement in the respective switch point; wherein the switch frog comprises first and second vertically displaceable rail segments in order to establish a switch movement at the switch frog; wherein each railway switch blade and each switch frog rail segment is provided with a respective displacement mechanism; wherein each respective displacement mechanism comprises at least one pair of cooperating wedges having a lower wedge and an upper wedge; wherein said at least one pair of cooperating wedges is arranged such that relative displacement between the lower and upper wedges causes a vertical movement of at least the upper wedge; and wherein at least one wedge of the at least one pair of cooperating wedges is arranged to be displaced in a longitudinal direction of the switch mechanism, or in a direction substantially parallel to a longitudinal direction of the switch blade or substantially parallel to a longitudinal direction of the switch frog rail segment, respectively.

According to a fourth aspect of the invention, the object is at least partly achieved by a method for operating a railway switch mechanism according to the third aspect.

The vertical displacement is advantageous over horizontal displacement in terms of avoiding clamping snow and ice. The displacement mechanism provides the necessary vertical displacement and may have various different technologies for providing the vertical displacement, such as for example one or more wedges, hydraulic rams, pivoting motion, or the like.

By providing each respective displacement mechanism with at least one pair of cooperating wedges having a lower wedge and an upper wedge, large support surfaces may be provided, such that load/area on the displacement mechanism can be kept relatively small. This results in reduced wear and enables use of less costly materials.

Relative displacement of two cooperating wedges provides an efficient and cost-effective solution for implementing the displacement mechanism.

Moreover, by arranging the switch such that at least one wedge of the at least one pair of cooperating wedges may be arranged to be displaced in a longitudinal direction of the switch mechanism, or in a direction substantially parallel to the longitudinal direction of the switch blade or substantially parallel to the longitudinal direction of the switch frog rail segment, respectively, vertical displacement of a long segment by means of a single actuator is enabled. A singe actuator may be connected directly and/or indirectly to multiple wedges/support elements arranged in series. Furthermore, the displacement mechanism can be more easily more integrated into a switch mechanism frame structure if such is used, thereby simplifying heating of the displacement mechanism if required. Moreover, parallel arrangement of the actuators also provides a more compact switch mechanism design which is an important factor when multiple switches are located close to each other.

Furthermore, by having the switch blades deformed elastically in the vertical direction for enabling the desired vertical displacement thereof any discrete hinged connection point to the closure rail is eliminated, such that a more continuous rail is provided. Each discontinuation, each gap, in the rail implies more noise, more vibrations, less robustness and reliability. A continuous rail is thus generally advantageous. The switch blade and closure rail are thus essentially the same element, since no specific location can be determined separating the switch blade from the closure rail. Moreover, by using the natural vertical elasticity of the switch blades more conventional railway track components may be used in the switch mechanism, thereby reducing cost of the switch mechanism. When the alternative design of having pivotally connected switch blades is used less force may be required to bend the rail. i.e. less force may be needed for forcing the switch blade down for enabling a wheel passing by with being led into a diverging path.

Further advantages are achieved by implementing one or several of the features of the dependent claims.

The at least one pair of cooperating wedges may be connected with a switch blade or a switch frog rail segments such that the vertical movement of at least the upper wedge is transmitted to a vertical movement of at least a portion of the first and second switch blade or at least a portion of the first and second switch frog rail segment.

According to an example embodiment, the switch mechanism may be suitable for switching railway wheels of a railway car traveling on a railway diverging in to a first and a second direction, and the switch mechanism may comprise a first pair of running rails diverging into a second and third pair of running rails, wherein the first pair of running rails may comprise a first and a second outer rail and the switch frog may diverge into a first and a second inner rail, the second pair of running rails may comprise the first outer rail and the first inner rail, the third pair of running rails may comprise the second outer rail and the second inner rail, the first switch blade may extend at least partly between the first outer rail and the switch frog, and the second switch blade may extend at least partly between the second outer rail and the switch frog.

According to an example embodiment, each respective displacement mechanism may comprise at least one wedge. The wedge may be stationary or displaceable, and may cooperate with another wedge-shaped or non-wedge-shaped component. The displacement motion of the non-stationary part is typically substantially in a horizontal place, in particular in a direction parallel with a longitudinal direction of an associated switch blade/rail segment or parallel with a longitudinal direction of the switch mechanism.

According to an example embodiment, the displacement of the at least one wedge or relative displacement between the lower and upper wedge may be provided by means of an actuator acting on the at least one wedge or on at least one of the upper and the lower wedge. A single or multiple actuators may be provided for each displacement mechanism. One of the upper and lower wedge may be stationary and the other wedge moveable for vertical displacement. Lubrication may be provided if sliding contact is used for the relative displacement.

According to an example embodiment, each displacement mechanism of the railway switch blade and/or switch frog rail segment may comprise a plurality of pairs of cooperating wedges spread over at least a portion of the first and second switch blade and/or a portion of the first and second switch frog rail segment. A plurality of pairs of cooperating wedges spread over a certain portion provides a highly distributed load and enables cost-efficient progressive vertical displacement over the length of the portion.

According to an example embodiment, at least two of the plurality of pairs of cooperating wedges of each displacement mechanism of the railway switch blade and/or switch frog rail segment may be provided with different wedge inclinations, such that the same relative displacement in the same horizontal direction of the two different pairs of cooperating wedges give different magnitude of the movement in vertical direction of the respective pair of cooperating wedges. This design provides cost-efficient progressive vertical displacement over the length of a rail portion.

According to an example embodiment, the switch frog may comprise a frog tip and first and second vertically displaceable rail segments are arranged to selectively establish a continuous rail path from the first and second switch blade to the frog tip respectively. A continuous rail path effectively eliminates, or at least reduces, the conventional gap that is normally provided at a stationary frog. A gap may cause safety problems because of the reduced lateral support via the flange of the wheel passing the gap. There may also be reduced vertical load area available for the wheel passing the gap such the excessive stress may be exerted on the frog, and in case the wheel drops into the gap a certain amount upon passing noise and chock will be induced reducing rail passenger comfort and increasing wear.

According to an example embodiment, the displacement mechanisms of the railway switch blades may be positively secured to an underside support structure of the displacement mechanisms and to the switch blades, and/or the displacement mechanisms of the switch frog rail segments may be positively secured to an underside support structure of the displacement mechanisms and to the switch frog rail segments. By positively securing the displacement mechanism to an underside support structure and the switch blade, and/or to an underside support structure and the switch frog rail segment, it is possible control the vertical position of each railway switch blade and/or each switch frog rail segment with certainty by means of the actuating position of the displacement mechanism. The risk that the switch blade and/or the switch frog rail segment will always remain at an elevated position, irrespective of displacement mechanism, such that potential derailing can occur due to incorrect switching position of switch blades and/or switch frog rail segments. Positive locking herein means a fastening means that remains functional both in positive and negative locking force mode, i.e. both when the displacement mechanism pushes the switch blade upwards towards its upper position and when the displacement mechanism pulls the switch blade downwards towards its lower position. This functionality is particularly advantageous when purely elastic deformation of the switch blade and/or switch frog rail segments is used for obtaining the desired vertical displacement, because gravity may be insufficient for providing the sufficient vertical downward force needed to reach the lower position. Positive securement may for example be realised by means of a tongue having an undercut located in a groove in case relative displacement between the parts must be possible. In case no relative displacement is required positive locking may be accomplished by threading elements, fasteners embedded during manufacturing, such as cast-in, or the like.

According to an example embodiment, the switch frog rail segments may be deformed elastically in the vertical direction for enabling the desired vertical displacement thereof. This design is advantageous because each rail segment thereby lacks a discrete hinged connection point to the closure rail, such that less discontinuous rails are provided. Each discontinuation, each gap, in the rail implies more noise, more vibrations, less robustness and reliability. A continuous rail is thus generally advantageous. In this example embodiment, the switch grog rail segment and closure rail are essentially the same element, since no specific location can be determined separating the rail segment from the closure rail. Moreover, by using the natural vertical elasticity of the switch frog rail segments more conventional railway track components may be used in the switch mechanism, thereby reducing cost of the switch mechanism.

According to an example embodiment, the switch frog rail segments may be pivotally connected by hinged joints to first and second closure rails respectively for enabling the desired vertical displacement of the switch frog rail segments. This is an alternative example embodiment to above. Pivotal connection of the rail segments to the closure rails result in less force required to bend the rail. i.e. less force for forcing the rail segment down for enabling a wheel passing by with being led into a diverging path. According to yet a further example embodiment the switch blades may use its elasticity for accomplishing the vertical displacement whilst the switch frog rail segments rely on pivotal connected between the rail segments and closure rail, or oppositely.

According to an example embodiment, the switch mechanism may be arranged at least partly on at least one frame provided with a bottom and at least two side walls extending therefrom, a first outer rail and second outer rail may be arranged on said at least two side walls and the displacement mechanisms are located in least partly within a space defined by the bottom and the at least two side walls. A frame enables high control and accuracy of the relative position of the elements of the switch mechanism, as well as heating of the switch mechanism. The bottom of the frame may have a rectangular shape and a side wall on each side thereof, i.e. four side walls surrounding a hollow inside of the frame.

According to an example embodiment, a the switch mechanism may be arranged at least partly on a first frame arranged at least partly surrounding the first and second switch blades, and a second frame may be arranged at least partly surrounding the switch frog. This design enables cost-efficient design and manufacture of the switch mechanism.

According to an example embodiment, the first frame additionally may comprise a lateral side wall adjacent a heel end of the switch blades, the lateral side wall may be arranged to provide support for enabling the desired vertical displacement of the switch blades, the second frame additionally may comprise a lateral side wall adjacent a heel end of the switch frog rail segments, and the lateral side wall may be arranged to provide support for enabling the desired vertical displacement of the switch frog rail segments.

According to an example embodiment, a cover is provided on top of at least one of the first and second frame for at least partly covering the displacement mechanisms. The cover assists in keeping the internal space of the each frame clean and free from snow and ice, as well as improved heat insulation.

According to an example embodiment, an insulating cover may be provided on the frame for covering the displacement mechanisms. The insulating cover is designed for maintaining a heat transfer barrier against cold air entering into the inside of the frame. The insulating cover may also function as a barrier against snow, rain and ice entering the inside of the frame, such that any components therein, such as the displacement mechanism, are better protected.

According to an example embodiment, the frame may be made out of concrete and is provided with an electrical heating mechanism. Frame heating may be an advantageous additional feature for further enhancing the winter functionality of the switch mechanism.

According to an example embodiment, the at least one frame may be arranged to provide lateral support to the at least one displacement mechanism. Lateral support means support in a direction transverse to a longitudinal direction of a motion of at least one member of the displacement mechanism during vertical displacement. Such lateral support serves to maintain the elements of the displacement mechanism, such as cooperating wedges, in proper mutual relationship, and to control the motion of the displacement mechanism during vertical displacement. The longitudinal side walls of the frame are particularly suitable for providing the lateral support.

According to an example embodiment, at least one displacement mechanism may be located at least partly in a metal channel providing lateral support to the at least one displacement mechanism. A metal channel may be designed to provide strong lateral support in both lateral directions. A metal channel may also provide good sliding surface for any moving members of the vertical displacement mechanism, such as moving wedges.

According to an example embodiment, the metal channel may be located side by side with a side wall of the at least one frame. Such arrangement may take advantage of the strong lateral support provided by the side wall of the frame, such that the metal channel itself may provide less lateral support. This allows use of reduced wall thickness of the metal channel for saving cost.

According to an example embodiment, the metal channel may comprise a stopping arrangement for providing a limit to the vertical displacement of the displacement mechanism in an upward direction. It may be advantageous to set the vertical displacement mechanism in tension at the upper position of the switch blades or rail segments for reducing play, vibrations and rattle in the displacement mechanism. By forcing the vertical displacement mechanism against the stopping arrangement at the upper position a more reliable and robust switch mechanism is provided.

According to an example embodiment, the stopping arrangement may comprise at least one abutment member projecting into the metal channel and arranged to come into engagement with the displacement mechanism or an intermediate support member at the upper position of one of the first and second switch blades or first and second rail segments.

According to an example embodiment, at least one displacement mechanism of the first and the second switch blades and of first and second rail segments is located in a frame that has a bottom, two transverse side walls and two longitudinal side walls enclosing the displacement mechanism. This provides improved protection against snow and dirt from the outside.

According to an example embodiment, the frame is secured to a plurality of underlying sleepers. Using sleepers as a cost-efficient solution for supporting the rail and switch mechanism.

According to an example embodiment, at least one of the sleepers that supports the frame also supports a first and/or a second outer rail of the railway switch mechanism. This enables a dual functionality of the sleepers.

According to an example embodiment, at least one of the first and second switch blades and the first and second rail segments are fastened to intermediate support members respectively, and the displacement mechanisms are connected to the intermediate support members and arranged for displacing the intermediate support members in the vertical direction. Using intermediate support members simplifies installation of the switch mechanism because the switch blades must merely be fastened to the intermediate support members.

According to an example embodiment, at least one of the intermediate support members closes the upper surface of an internal space defined by each frame. This further improves the protection of the displacement mechanism surrounded by the frame.

According to an example embodiment, at least one of the intermediate support members comprises a first part and a second part, wherein one end of the first part is pivotally connected to an upper side of a transverse side wall of the frame at a first pivot point and the opposite end of the first part is pivotally connected to the second part at a second pivot joint. This design enables a long segment of the switch blades being vertically displaced without needing excessive space for the switch points in lowered position.

According to an example embodiment, the displacement mechanism controlling the motion of the first part comprises a plurality of longitudinally spaced apart pair of cooperating wedges, each of which having a unique angle of inclination. This provides a distributed support for the first part.

According to an example embodiment, the displacement mechanism controlling the motion of the second part is arranged to vertically displace the second part while maintaining its horizontal orientation fixed. This design enables a long segment of the switch blades being vertically displaced without needing excessive space for the switch points in lowered position.

According to an example embodiment, the displacement mechanism controlling the motion of the second part comprises a plurality of longitudinally spaced apart pair of cooperating wedges having the same angle of inclination. This design enables a long segment of the switch blades being vertically displaced without needing excessive space for the switch points in lowered position.

According to an example embodiment, the displacement mechanism comprises a pull-down control member, which is connected to an underlying support structure and the intermediate support member, wherein the pull-down control member comprises a track with an inclined path and a guide member arranged to be guided by the track.

According to an example embodiment, the displacement mechanism comprises a longitudinally extending longitudinally slidable control member drivingly connected to an actuator, wherein a part of a pull-down control member or a wedge is attached to the control member, and the control member is secured against vertical displacement.

Further areas of applicability will become apparent from the description provided herein.

BRIEF DESCRIPTION OF DRAWINGS

In the detailed description below reference is made to the following figure, in which:

FIG. 9*a* shows a cross-sectional view of the frame of FIG. 8 having the displacement mechanism in a first position, FIG. 9*b* shows a cross-sectional view of the frame of FIG. 8 having the displacement mechanism in a second position, FIG. 10 shows a perspective view of a frame including a displacement mechanism for switch blades.

DETAILED DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1:
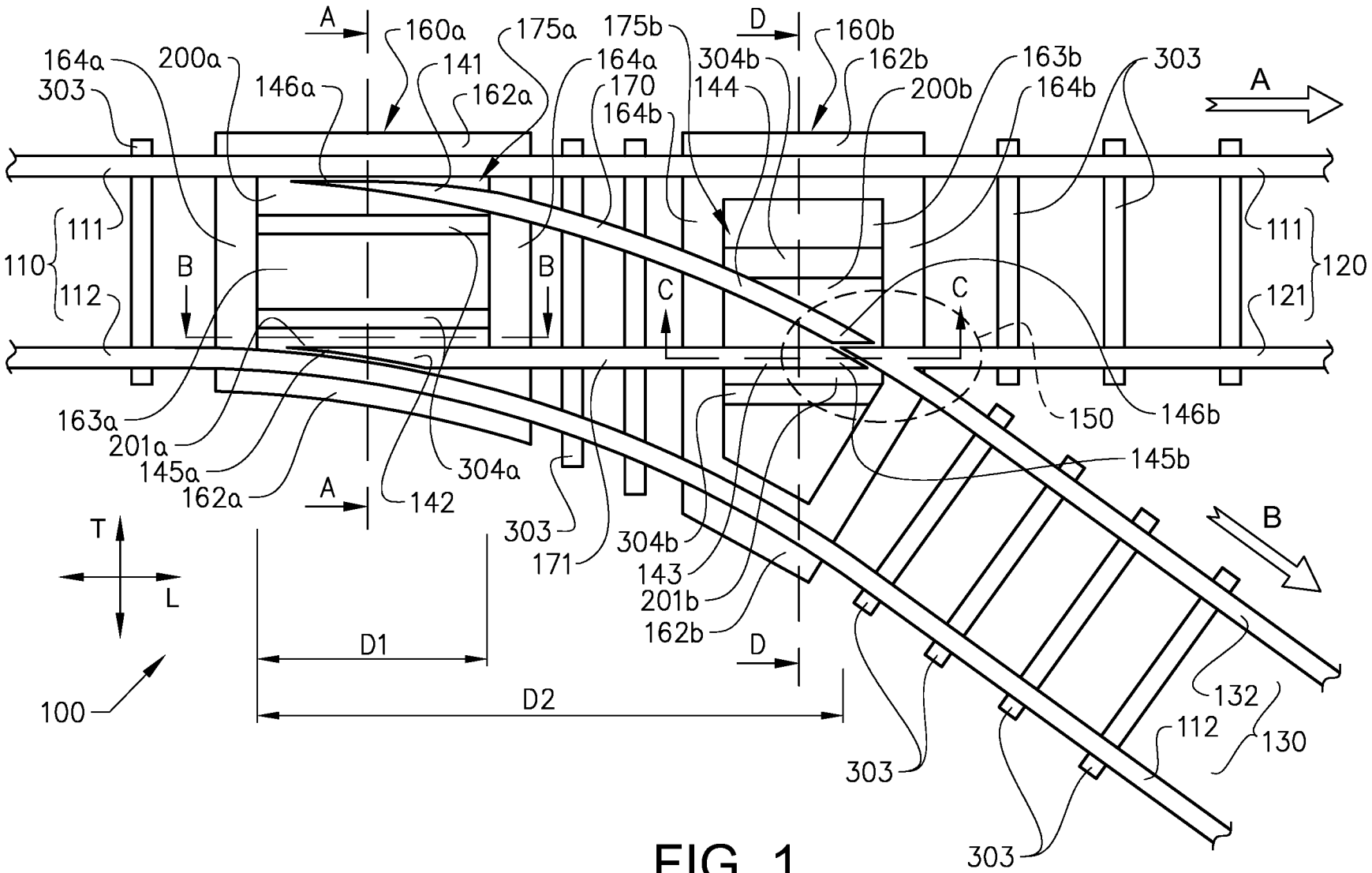
FIG. 1 shows a schematic top view of an example embodiment of the switch mechanism.

FIG. 1 of the drawings schematically illustrates a right-hand railway switch mechanism 100 suitable for switching railway wheels of a railway car traveling on a railway diverging in to a first and a second direction A, B. The switch mechanism 100 comprises a first pair of running rails 110 diverging into a second and third pair of running rails 120; 130 respectively. The first pair of running rails 110 comprises a first and a second outer rail 111; 112, also sometimes referred to as stockrails. The switch mechanism 100 further comprises a switch frog 150 that is connected to a first and a second diverging inner rails 121; 132. The second pair of running rails 120 comprises the first outer rail 111 and the first inner rail 121, wherein the first outer rail 111 sometimes is referred to as outer straight lead rail. The third pair of running rails 130 comprises the second outer rail 112 and the second inner rail 132, wherein the second outer rail 112 sometimes is referred to as inner curve lead rail.

A first switch blade 141 extend at least partly between the first outer rail 111 and the switch frog 150, and a second switch blade 142 extend at least partly between the second outer rail 112 and the switch frog 150. A switch point 145*a*; 146*a* of each of the first and the second switch blades 141; 142 is vertically displaceable in order to establish a switch movement in the respective switch point 145*a*; 146*a*.

In the embodiment of FIG. 1, the first and second switch blades 141, 142 have no distinct extension because both the first and second switch blades are vertically displaceable by means of elastic deformation of the switch blades 141, 142. There is thus a gradual transformation of the switch blades 141, 142 into fixed rail segments upon approaching the switch frog. The fixed rail segments located between the switch frog and switch blades 141, 142 are referred to as first and second closure rails 170, 171.

Each railway switch blade 141, 142 is provided with a respective displacement mechanism 200*a*, 201*a* by means of which at least a portion of the first and second switch blade can be displaced in a vertical direction to at least an upper and a lower position. Each individual displacement mechanism 200*a*, 201*a* is preferably located below the first and second switch blade 141, 142, respectively for enabling the desired vertical displacement of the switch blade 141, 142.

In the example embodiment of FIG. 1, the switch mechanism 100 is arranged on a first frame 160*a* and a second frame 160*b*. The first and second frames 160*a*, 160*b* are provided partly for providing strong structural support to the switch mechanism 100, for ensuring that the vertical displacement mechanisms 200*a*, 201*a* remain in correct relative location to the switch blades 141, 142 and outer rails 111, 112, and for enabling cost-efficient installation of the switch mechanism by enabling prefabrication of the switch mechanism including rail segments, switch blades, closure rails, switch frog, frame, etc.

The first frame 160*a* is provided with a bottom 161*a*, two longitudinal side walls 162*a* and two transverse side walls 164*a* extending from the bottom upwards. An internal space 163*a* is defined by said side walls 162*a*, 164*a* and bottom 161*a* and the displacement mechanisms 200*a*, 201*a* are located within the space 163*a*. Location of the displacement mechanisms 200, 201 within the space 163*a* has the advantage of allowing a more protected installation of the displacement mechanisms 200*a*, 201*a* against climate, debris, snow, ice, etc. Moreover, the frame enclosure allows more cost-efficient heating of the displacement mechanisms 200*a*, 201*a* and switch blades 141, 142.

A longitudinal direction L herein denotes a direction parallel to the first pair of running rails 110 directly before the switch mechanism 100, and the transverse direction T is extending perpendicular to longitudinal direction L.

A longitudinal distance D1 of the displacement mechanism 200*a*, 201*a* of the switch blades 141, 142 may typically be in the range of 10-70% of the longitudinal distance D2 between a gap of the switch frog 150 to a distal end of the displacement mechanism 200*a*, 201*a*, specifically in the range of 10-50%, more specifically in the range of 20-40%. The longitudinal distance D1 of the displacement mechanism 200*a*, 201*a* is preferably short for enabling use of a compact and cost-effective displacement mechanism 200*a*, 201*a*, but the rigidity of the switch blades 141, 142 may require a relatively long longitudinal distance D1 for enabling a sufficient gradual elastic deformation of the switch blades 141, 142 for allowing a wheel flange of a railway wheel to pass the vertically downwardly displaced switch blade 141, 142 without contact therebetween and an additional safety margin for allowing for variations over time. The length of longitudinal distance D1 may typically be in the range of 3-12 meters, specifically in the range of 4-8 meters, for example depending on the radius of curvature of the diverging railway track.

In the example embodiment of FIG. 1, the first and second outer rails 111, 112 are arranged at least partly on the two longitudinal side walls 162*a* of the first frame 160*a*. In the example embodiment of the first frame 160*a*, the shape of the first frame 160*a* is adapted to the location and extension of the first and second outer rails 111, 112 while striving towards surrounding substantially the entire first and second displacement mechanisms 200*a*, 201*a*. As a result, the first frame 160*a* may have a non-symmetrical shape Both the first and second outer rails 111, 112 may be arranged on a longitudinal side wall 162*a* along substantially the entire longitudinal length of the first frame 160*a*. In the example shown in FIG. 1, the longitudinal side wall 162*a* of the first frame 160*a* located towards the side of the diverging track is shaped to gradually diverge outwardly towards the diverging track for enabling the second outer rail 112 to be mounted on top of, and follow the extension of the side wall 162*a* along substantially the entire longitudinal length of the first frame 160*a*. However, the first frame 160*a* may alternatively have a rectangular shape, such that the second outer rail 112 starts to diverge out from the longitudinal side wall towards the second direction B in a region adjacent the second switch point 145*a*.

The switch mechanism 100 additionally comprises a switch frog 150. The switch frog may also be referred to as switchable crossing. The switch frog 150 comprises a frog tip 151 and first and second vertically displaceable rail segments 144, 143 in order to establish a switch movement at the switch frog 150. The switch movement at the switch frog is arranged to selectively establish a continuous rail path between the first and second closure rails 170, 171 and the frog tip 151 respectively.

Conventional stationary and non-controlled frogs comprise a gap in each rail at the frog tip 155 for enabling the flange of the railway wheels to pass the frog. Without such a gap a railway wheel could never escape out from the boundaries of the right and left rail tracks due the wheel flange that extends downwardly below the upper rolling surface of the rails. The gap at the crossing however enables this escape, such that a railway vehicle can switch from one track to another track. However, it is sometimes desirable to close the gap at the frog for improving comfort, handling and safety of the frog. Conventional switch frogs use horizontal motion of the frog tip for enabling switching of the switch frog. The switch frog rail segments 144, 143 according to the invention are instead configured to be deformed elastically in the vertical direction for enabling the desired vertical displacement thereof.

In the example embodiment of FIG. 1, each switch frog rail segment 144, 143 is provided with an individual vertical displacement mechanism 200*b*, 201*b* by means of which at least a portion of the first and second switch frog rail segments 144, 143 can be displaced in a vertical direction to at least an upper and a lower position. As discussed in relation to the switch blades 141, 142, a vertical displacement results in significantly improved winter reliability and robustness compared with a horizontally displaced frog tip at the switch frog 150.

According to the example embodiment of FIG. 1, a second frame 160*b* is provided for better controlling the vertical displacement of the switch frog rail segment 144, 143. The second frame 160*b* is configured to substantially surround the switch frog rail segments 144, 143. In the example embodiment of FIG. 1, the second frame 160*b* is provided with a bottom 161*b*, two longitudinal side walls 162*b* and two transverse side walls 164*b* extending from the bottom upwards. An internal space 163*b* is defined by said side walls 162*b*, 164*b* and bottom 161*b* and the displacement mechanisms 200*b*, 201*b* are located within the space 163*a*. Location of the displacement mechanisms 200*b*, 201*b* within the space 163*a* has the advantage of allowing a more protected installation of the displacement mechanisms 200*b*, 201*b* against climate, debris, snow, ice, etc. Moreover, the frame enclosure allows more cost-efficient heating of the displacement mechanisms 200*b*, 201*b* and switch frog rail segments 144, 143.

Many different geometrical designs of the second frame are feasible and the design shown in FIG. 1 is merely one example embodiment thereof. The transverse side wall 164*b* of the second frame 160*b* located furthest away from the switch blades 141, 142 is here shown extending substantially in a lateral direction L across the second pair of running rail 120 and beneath at least part of the frog tip for providing adequate and rigid support to the frog tip. At about the frog tip the direction of the transverse side wall 164*b* changes slightly to extend perpendicular to the longitudinal direction of the third pair of running rails 130. The two longitudinal side walls 162*b* of the second frame 160*b* extends substantially along the first and second outer rails 111, 112, and the first and second outer rails 111, 112 are located in top of said longitudinal side walls 162*b*. The remaining transverse side wall 164*b* closes the second frame 160*b* and defines an internal space 163*b*.

Each vertical displacement mechanism 200*a*, 201*a*, 200*b*, 201*b* of the switch blades 141, 142 and switch frog rail segments 144, 143 has generally an elongated shape. The reason behind this shape is partly for enabling the vertical displacement of the switch blades 141, 142 and rail segments 144, 143 to occur solely based on elastic deformation of the switch blades 141, 142, rail segments 144, 143 and any closure rails 170, 171, and partly for providing the necessary vertical support to the switch blades 141, 142 and rail segments 144, 143 for carrying the load of a railway car without unacceptable level of deflection.

The switch blades 141, 142 and rail segments 144, 143 are similar to a cantilever beam in that they are permanently anchored at one end only, i.e. the end heel. The switch blades 141, 142 and rail segments 144, 143 are typically made of steel and must therefore have a significant length for enabling the desired vertical displacement at the switch points 145*a*, 146*a*, 145*b*, 146*b* of the switch blades 141, 142 and rail segments 144, 143 without exceeding the limit for permanent deformation of the switch blades 141, 142 and rail segments 144, 143. Unless the displacement mechanisms 200*a*, 201*a*, 200*b*, 201*b* provide a distributed support to the switch blades 141, 142 and rail segments 144, 143 they may locally deflect downwards when carrying the load of a passing railway car. Such deflection may induce a safety risk due to quicker aging of the switch blades 141, 142 and rail segments 144, 143, as well as uneven railway track. Therefore, the displacement mechanisms 200*a*, 201*a*, 200*b*, 201*b* may advantageously be arranged to provide substantially continuous support to the switch blades 141, 142 and rail segments 144, 143 over a substantial length thereof, or to provide a plurality of individual supports distributed regularly or irregularly over the length thereof.

The displacement mechanisms 200*a*, 201*a*, 200*b*, 201*b* will consequently frequently exhibit an elongated shape with a length substantially exceeding the width thereof, when viewed from above. The direction of elongation of the displacement mechanisms 200*a*, 201*a*, 200*b*, 201*b*, i.e. their longitudinal orientation are schematically shown in FIG. 1 as extending substantially in the longitudinal direction L of the switch mechanism. This arrangement must be seen one example embodiment out of many alternative possible configurations. One advantageous alternative embodiment would for example be an arrangement where the longitudinal direction of each displacement mechanisms 200*a*, 201*a*, 200*b*, 201*b* is oriented more aligned with the rail section it controls. With such an arrangement, each displacement mechanisms 200*b*, 201*b* of the switch frog would not be arranged in the longitudinal direction L as shown in FIG. 1, but instead be aligned with the first and second switch frog rail segments 144, 143 respectively.

Sleepers 303 are schematically included in FIG. 1 for improving comprehension of the invention but has no effect on the invention as such.

Many alternative configurations of the switch mechanism 100 are possible without leaving the scope of the invention. For example, the first and second frames 160*a*, 160*b* may be interconnected by some connection device for ensuring that the relative position of the first and second frame 160*a*, 160*b* does not change over time. Furthermore, a single frame surrounding both the switch blades 141, 142 and the switch frog 150 may be implemented instead. Such a single frame could for example be provided with at least two intermediate frame walls extending in the transverse direction T for providing support for the displacement mechanism 200*a*, 201*a*, 200*b*, 201*b* and enabling elastic bending of the switch blades 141, 142 and switch frog rail segments 144, 143.

The functionality of the switch mechanism 100 will be described in relation to FIG. 1. By controlling the first and second switch blades 141, 142 such that only one of the switch blades 141, 142 is in the upper position while the other switch blade 141, 142 is in the lower position, switching of a railway wheel of a railway car approaching the switching mechanism 100 on the first pair of running tracks 110 can be performed, such that the railway car can be made to selectively follow either the first and second direction A, B. For example, when it is desired that a railway car arriving to the switch mechanisms 100 on the first pair of running rails 110 should pass straight over the switch mechanisms 100 and continue along the first direction A, the first switch blade 141 is displaced to its lower position and the second switch blade 142 is displaced to its upper position. Thereby, a flange of a left railway wheel of the railway car will not follow the first switch blade 141 simply because the flange passes above the switch blade 141 and does consequently not come into contact with the first switch blade 141. Moreover, the right railway wheel is prevented from following the second outer rail 112 due to the flange of the right wheel potentially contacting an inside surface the second switch blade 142. As a result, the left wheel of the railway car will continue along the first outer rail 111 and the right wheel will follow the second switch blade 142 towards the second closure rail 172.

In another example, when it is desired that a railway car arriving to the switch mechanisms 100 on the first pair of running rails 110 should diverge and continue along the second direction B instead, the first switch blade 141 is displaced to its upper position and the second switch blade 142 is displaced to its lower position. Thereby, the flange 412 of the left railway wheel 409 of the railway car is forced to follow the first switch blade 141 and the right wheel will follow the second outer rail 112.

The switch frog 150 may be controlled to switch in accordance with the switch blades 141, 142. This means that the first switch frog rail segment 144 is controlled to be located in its upper position when the first switch blade 141 is controlled to be located in its upper position, and that the second switch frog rail segment 143 is controlled to be located in its upper position when the second switch blade 142 is controlled to be located in its upper position. This control arrangement, in combination with only allowing a single switch blade 141, 142 in the upper position at a time, ensures that the first rail segment 144 is in upper position when railway car is travelling towards the second direction B, and that the second rail segment 143 is in the upper position when the railway car is travelling towards the first direction A.

The displacement mechanism should be secured to the bottom 161 of the frame 160 as well as the switch frog rail segment. Thereby, it is possible control the vertical position of each railway segment with certainty by means of the actuating position of the displacement mechanism. As discussed above, the positive securement may be realised by means of a substantially longitudinally extending interlocking tongue and groove connection (not shown) between the upper and lower wedge 212, 211, such that longitudinal relative sliding displacement is possible.

Figure 2:
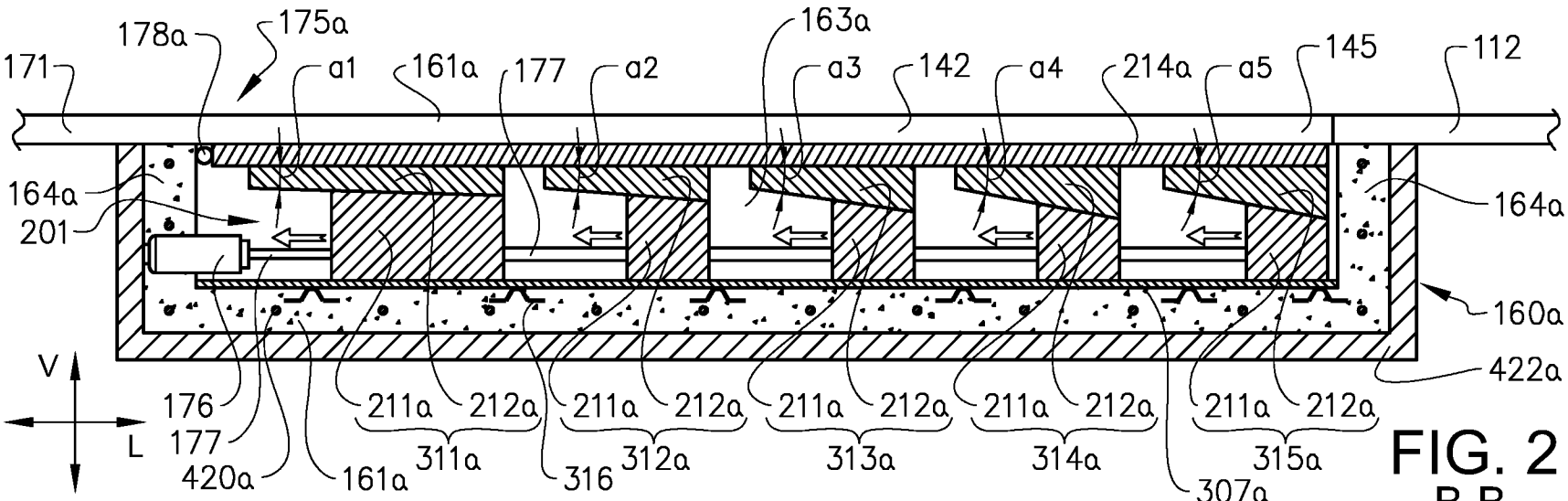
FIG. 2 shows a schematic cross-sectional cut along line B-B with a switch blade in the upper position.

FIG. 2 schematically shows a cross-sectional cut through the switch mechanism 100 at cut B-B in FIG. 1 with the second switch blade 142 in an upper position. The first frame 160*a* is shown having a bottom 161*a* and two parallel transverse side walls 164*a*. The second outer rail 112 is positioned on a top surface of a side wall of the first frame 160*a* and extends past the first frame 160*a*. The second closure rail 171 is shown positioned on the top surface of the transverse side wall 164*a* positioned closest to the switch frog 150. There is no clear location where the second closure rail 171 transforms into the second switch blade 142 because the elastic deflection of the continuous rail forming the second closure rail 171 and second switch blade 142 depends on many parameters, such as rail dimensions, rail material, frame design, vertical displacement mechanisms design, etc. Possibly, the deflection will start adjacent the transverse side wall 164*a* positioned closest to the switch frog, because the rail is mechanically deflected downwards only within the first frame 160*a* and not in the region of the second closure rail 171.

An example embodiment of the displacement mechanism 20*a*1 is shown in FIG. 2, wherein the example displacement mechanism 201 comprises a plurality of pairs of cooperating wedges 311*a*, 312*a*, 313*a*, 314*a*, 315*a*. Each pair of cooperating wedges 311*a*, 312*a*, 313*a*, 314*a*, 315*a* comprises a lower wedge 211*a* and upper wedge 212*b*, and each pair is arranged such that relative displacement between the lower and upper wedges 211*a*, 212*a* causes a vertical movement of the upper wedges 212*a*. The lower wedges 211*a* are supported directly or indirectly by the bottom 161*a* of the first frame 160*a* and cannot be lowered. Upon longitudinal displacement of the lower wedges 211*a* towards the left in FIG. 2, as shown by the arrows, the upper wedges 212*a* will consequently displace vertically downwards towards the bottom 161*a*. The upper wedges 212*a* are intended to be substantially fixed in the longitudinal direction L and only arranged to be displaced in the vertical direction V.

A second intermediate support member 214*a* is shown positioned above the upper wedges 212*a* in FIG. 2. The second intermediate support member 214*a* is here an intermediate member between the vertical displacement mechanism 201 and the second switch blade 142, wherein the second switch blade 142 is located on top of the intermediate support member 214*a*. The second intermediate support member 214*a* may for example be made of metal. The second intermediate support member 214*a* may also be connected to the transverse side wall 164*a* of the first frame 160*a* located at the heel end 175*b* of the rail segments 144, 143, for example by means of a pivotal or fixed connection 178*a*. Moreover, the second switch blade 142 may be fastened to the second intermediate support member 214*a* in any appropriate manner. Alternatively, the second intermediate support member 214*a* may possibly be omitted such that the second switch blade 142 is secured directly to the vertical displacement mechanism 201, e.g. directly to the upper wedges 212*a*. Such an alternative embodiment may be particularly advantageous when a single upper wedge 212*a* is used because the single upper wedge 212*a* could also function as cover of the displacement mechanism 201 However, when a plurality of upper wedges 212*a* are use, as shown in FIG. 2, it may be advantageous to use an continuous intermediate support member 214*a*.

The plurality of pairs of cooperating wedges are connected with the second switch blade 142 such that the vertical movement of the upper wedges 212*a* induced a vertical corresponding movement of the second switch blade 142.

As illustrated in FIG. 2, the plurality of pairs of wedges is distributed over the longitudinal length of the second switch blade 142. Moreover, the plurality of pairs of cooperating wedges are also provided with different wedge inclinations α1, α2, α3, α4, α5, such that the same relative displacement in the longitudinal direction of each pair of cooperating wedges gives different magnitude of the movement in vertical direction of the respective pair of cooperating wedges. The pair 315*a* with the largest inclination provides the largest vertical displacement for a given displacement in the longitudinal direction of the lower wedge 211*a*. This design is used for obtaining a gradual deflection of the switch blade 142 over the length of the switch blade 142.

A gradual deflection induced by means of a plurality of pairs of cooperating wedges 311*a*, 312*a*, 313*a*, 314*a*, 315*a* distributed over the length of the switch blade is advantageous in terms of controllability of the deflection of the switch blade over the length of the switch blade 142. This controllability ensures that the switch blade does not easily deforms plastically near the supporting transverse side wall 164*a* at the heel end of the switch blade 142.

In the example embodiment of the vertical displacement mechanism 201 shown in FIG. 2, the upper wedges 212*a* may be stationary fastened to the underside of the second intermediate support member 214*a* by means of welding, fastening members, such as threaded members, or the like.

The inclined sliding surface of the each pair of cooperating wedges 311*a*, 312*a*, 313*a*, 314*a*, 315*a* preferably comprises some type of connection that allows relative sliding motion but prevents that the sliding surfaces disengaged from each other. The force required to elastically bend the second switch blade 142, and possibly also a second intermediate support member 214*a*, is likely larger than the gravity force, such that the second switch blade 142 possibly must be forced downwardly to the lower position. Such forcing is not possible if the wedges 211*a*, 212*a* of any pair of cooperating wedges are allowed to disengage and separate from each other in the vertical direction. Some type of longitudinally extending interlocking groove and tongue arrangement on the inclined sliding surface of the wedges 211*a*, 212*a* would provide the required engagement.

The lower wedges 211*a* are sliding along the bottom of the first frame 160*a*, either directly on the bottom, or on a bottom of a metal channel 307*a* if such a device is used. Also this sliding connection is preferably provided with some type of connection that allows longitudinal relative sliding motion but prevents the sliding surfaces from vertically disengaging each other. Some type of longitudinally extending interlocking groove and tongue arrangement on the sliding surface of the lower wedges 211*a* that is slidingly engaged with a sliding surface of the first frame 160*a* or metal channel 307*a* would provide the required engagement.

The actuating mechanism for providing the required longitudinal displacement of the lower wedges 211*a* comprises for example a hydraulic, pneumatic or electromechanical actuator connected to at least one lower wedge 211*a* via a rod 177. An electromechanical actuator, such as an electrical motor that drives threaded rod 177 may be advantageous because elimination of risk for hydraulic fluid leakage.

The length of the wedges 211*a*, 212*a* in the longitudinal direction L may be equal on all wedges, but the pair of cooperating wedges 311*a* located closest to the heel side of the second switch blade 142 is preferably longer in the longitudinal direction that the remaining pair of cooperating wedges because the pair of cooperating wedges located at the heel side carries more load that the pair of wedges located closer to the switch point 145*a*. The reason for this is that the second switch blade 142, in its upper position, will force a railway wheel to leave the second outer rail 112 and instead following the second closure rail and thereafter the first inner rail 121. In the beginning of this transition from the second outer rail 112 to the second closure rail 171 the weight of the load is still carried solely by the second outer rail 112. However, at a certain point, the railway wheel will leave the second outer rail 112 and at that position the entire load of the railway wheel is carried by the second switch blade 142. A larger longitudinal length of the wedges of a pair of cooperating wedges enables increased load with preserved load/area unit.

The first frame 160*a* may be provided with heating means, such as electrical conductors located embedded in part of the first frame 160*a* or on an internal surface of the first frame 160*a*. Other parts of the switch mechanism 100 may also or alternatively be heated, such as wedges 211*a*, 212*a*, intermediate support members 213*a*, 214*a* and/or switch blades 141, 142. An electrical air heater may also or alternatively be provided within the first frame 160*a* for increasing the dynamic response in case of quick weather changes. Frame heating may be an advantageous additional feature for further enhancing the winter functionality of the switch mechanism 100. Electrical heating means may alternatively, or in combination with frame heating, be applied directly to the switch blades 141, 142 and/or switch frog rail segments 144, 143. Electrical air heating may alternatively, or in combination with above-mentioned heating means, be provided within at least one frame 160*a*, 160*b*, for example by means of an electrical air blower. Electrical air heating may be advantageous in case of rapid changes in weather conditions. Frame heating via embedded heating wires reacts relatively slowly, but an air blower may relatively swiftly heat the internal space within a frame 160*a*, 160*b*.

Moreover, insulation 422*a* of the first frame 160*a* may also be provided for reducing heat loss from the first frame 160*a*. The insulation is preferably located under the first frame 160*a* and/or on the outside and/or inside of the of the side walls 162*a*, 164*a*.

Figure 3:
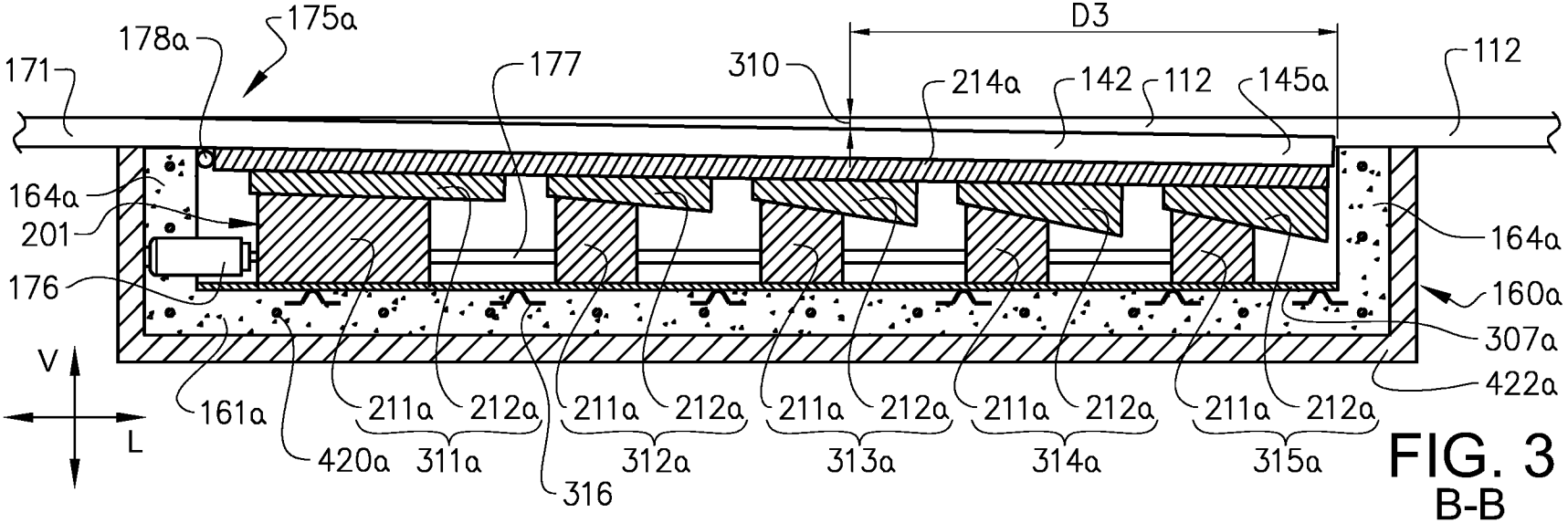
FIG. 3 shows a schematic cross-sectional cut along line B-B in FIG. 1 with a switch blade in the lower position.

FIG. 3 schematically shows the same cut B-B as FIG. 2 but with the second switch blade 142 in a lower position. Here all lower wedges 211*a* have been displaced towards the left in the figure a certain distance such as to enable the desired vertical displacement downwards of the respective upper wedges 212*a* due to the wedge inclinations α1, α2, α3, α4, α5 and the fact that the upper wedges 212*a* are substantially fixed in the longitudinal direction L. As a result, the second intermediate support member 214*a*, together with the second switch blade 142, are gradually vertically displaced towards the bottom, with substantially no displacement at all near a heel end 175*a* of the second switch blade 142 and maximal vertical displacement at the second switching point 145*a*.

The second switch blade 142, which is supported by the second vertical displacement mechanism 201 via the second intermediate support member 214*a*, is gradually vertically displaced along the length of the second switch blade, with maximal vertical displacement at the switching point. From a region where the fixed closure rail 171 transforms into a switch blade 142 the switch blade 142 starts to deform elastically to reach the lower switching portion. The elastic deformation continues more or less gradually along the second switch blade 142 towards the switching point 145*a*.

The vertical displacement of the second switch blade 142 must be sufficient for enabling the flange 412 of the railway wheel 411 to pass above the top side of the second switch blade 42 while following the second outer rail 112 towards the second direction B. If the distance D3 in FIG. 3 corresponds to the distance where the flange 412 has just completely passed over the second switch blade 142, the vertical displacement 310 of the second switch blade 142 must be larger or equal to the depth of the flange 410, and preferably plus a safety margin to ensure operational safety over time and with varying weather conditions.

Figure 4:
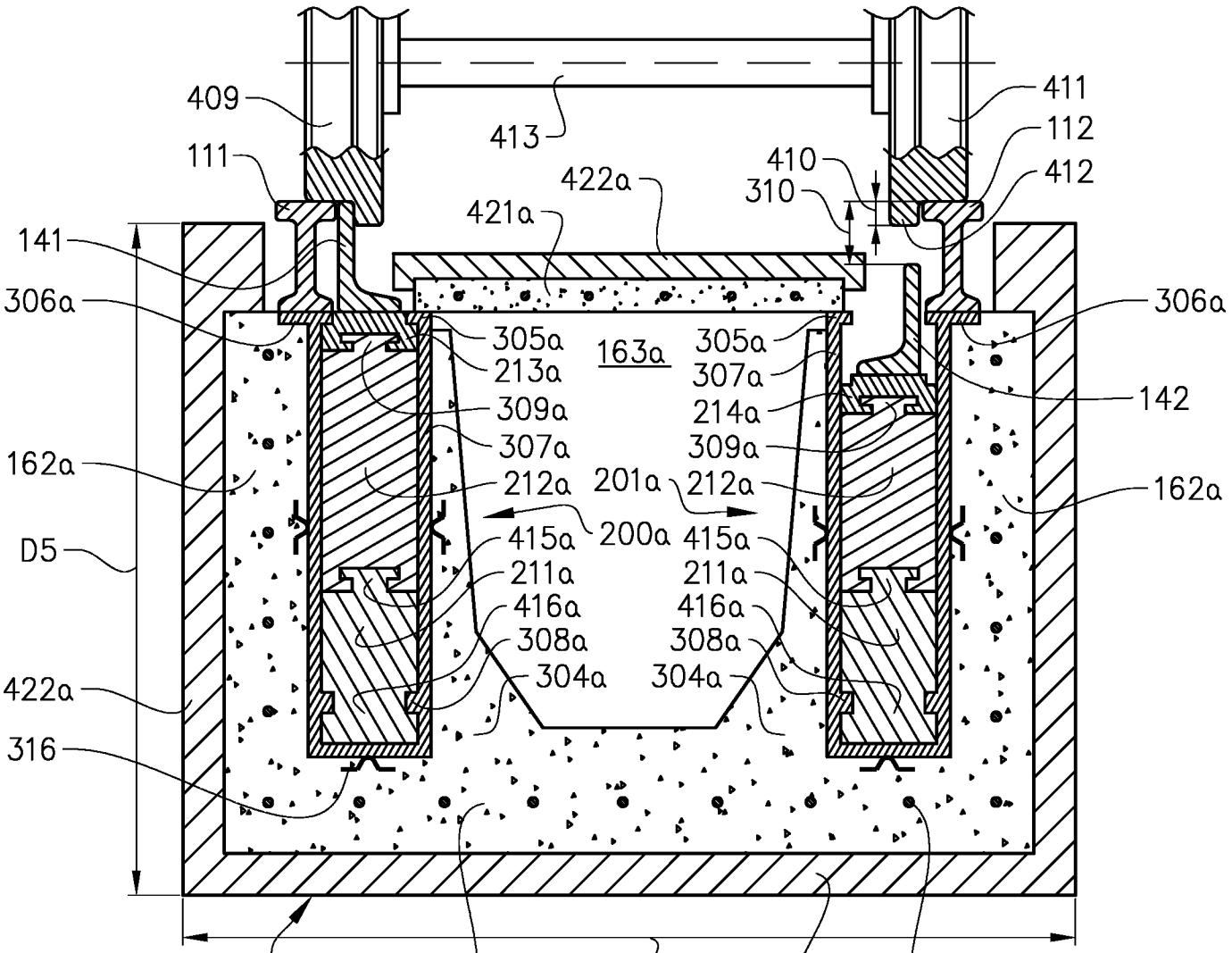
FIG. 4 shows a schematic cross-sectional cut along line A-A in FIG. 1.

FIG. 4 schematically shows a cross-sectional cut through the switch mechanism 100 at cut A-A in FIG. 1 with the first switch blade 141 in the upper position and the second switch blade 142 in the lower position, which corresponds to FIG. 3. In FIG. 4, the first frame 160*a* is shown having the bottom 161*a* and the longitudinal side walls 162*a*. It can be clearly seen that both the first and second outer rails 111, 112 are located on top of the side walls 162*a*.

Each of the first and second displacement mechanisms 200*a*, 201*a* of the switch blades 141, 142 are shown comprising a lower wedge 211*a* and upper wedge 212*a*. Positioned above each upper wedge 212*a* are the first and second intermediate support members 213*a*, 214*a* respectively. Finally, the first and second switch blades 141, 142 are positioned on top of the first and second intermediate support members 213*a*, 214*a* respectively. The first and second switch blades 141, 142 are thus vertically displaceable by means of the first and second displacement mechanisms 200*a*, 201*a*. In the shown example embodiment, the first and second displacement mechanisms 200*a*, 201*a* are located immediately next to the side walls 162*a*, thereby leaving a space 163*a* in the centre of the frame substantially empty.

In the example embodiment of FIG. 4 the first and second displacement mechanisms 200*a*, 201*a* are arranged within metal channels 307*a*. The metal channels 307*a* provide reliable support to the first and second displacement mechanisms 200*a*, 201 in the transverse direction T and they provide wearable and controllable sliding surfaces for the wedges 211*a*, 212*a*. Metal connection devices 316 may be fastened to the metal channel 307*a* for improved connection to the concrete first frame 160*a* after casting of the first frame 160*a*.

In the illustrated example embodiment of FIGS. 1-4 the lower wedges 211*a* are displaced by an actuator 176 in a substantially longitudinal direction. Each metal channel 307*a* is arranged to provide the necessary vertical support to the lower wedge 211*a* for avoiding that the lower wedge 211*a* becomes displaced in the vertical direction upon switching of the respective switch blade 141, 142. The lower wedges 211*a* should be prevented from being lifted in the vertical direction V when the switch blades are forced to deflect downwards from its natural position to the lower position, and the lower wedges 211*a* should also be prevented from being displacing downwardly in the vertical direction V when the switch blades carry a load of a train.

In the example embodiment of FIG. 4, this vertical support of the lower wedge 211*a* is realised by means of locking arrangement 416*a* that enables relative displacement of the of the lower wedge 211*a* and metal channel 307*a* while maintaining the vertical position of the lower wedge 211*a*. In particular, the locking arrangement 416*a* of the lower wedge 211*a* comprises an interlocking groove and tongue arrangement 308*a*. The groove and tongue arrangement 308*a* comprises some type of undercut preventing the lower wedge 211*a* and metal channel 307*a* from vertical disengagement.

In FIG. 4, the interlocking groove and tongue arrangement 308*a* is located on the side walls of the metal channel 307*a*, but this interlocking groove and tongue arrangement 308*a* may alternatively be arranged on a bottom side of the lower wedge 211*a*. The lower wedge 211*a* may additionally be arranged to have a bottom surface in sliding contact with the internal bottom surface of the metal channel 307*a* for improved vertical load transfer from the switching blades 141, 142 to the metal channel 307*a*.

For ensuring that also not the upper wedges 212*a* become lifted in the vertical direction V when the switch blades are forced to deflect downwards from its natural position to the lower position, locking means may be required between the lower and upper wedges 211*a*, 212*a* of each pair of cooperating wedges. In the example of FIG. 4, this is solved by means of a locking arrangement 415*a*, for example an interlocking groove and tongue arrangement, located in the contact area between the lower and upper wedges 211*a*, 212*a*. The groove and tongue arrangement 415*a* comprises some type of undercut preventing the upper wedge 212*a* and lower wedge 211*a* from vertical disengagement. The groove and tongue arrangement 415*a* also allows relative sliding motion between upper and lower wedges 212*a*, 211*a*.

Finally, also the first and second intermediate support members 213*a*, 214*a* may have to be fastened to the upper wedges 212*a* respectively for preventing mutual disengagement and for enabling the switch blades 141, 142 to be forced to deflect downwards from its natural position to the lower position. This may be arranged by means of locking arrangement 309*a* having for example an interlocking groove and tongue arrangement in the contact area between the upper wedges 212*a* and the first and second intermediate support members 213*a*, 214*a* respectively, as shown in FIG. 4. The groove and tongue arrangement comprises some type of undercut preventing the upper wedge 212*a* and first and second intermediate support members 213*a*, 214*a* respectively from vertical disengagement. However, considering that there is essentially no relative sliding motion between the first and second intermediate support members 213*a*, 214*a* and the upper wedges 212*a* in the embodiment of FIG. 4, also other type of locking arrangements may be used, such as welding, riveting, threaded fasteners.

Using a locking arrangement integrated in the wedges of the displacement mechanism 200*a*, 201*a*, 200*b*, 201*b* for ensuring downward deflection of the switch blades 141, 142 enables a railway switch mechanism 100 free from control members interconnecting the first and second displacement mechanisms 200*a*, 201*a*. Thereby less moveable parts are provided and the risk for disorder caused by snow, ice or dirt is reduced.

In the example embodiment of FIG. 4, the metal channel 307*a* comprises a stopping arrangement for providing a limit to the vertical displacement of the displacement mechanism 200*a*, 201*a* in an upward direction. The example stopping arrangement comprises abutment members 305*a*, 306*a* projecting into the metal channel 307*a* and arranged to come into engagement with the first and second intermediate support members 213*a*, 214*a* respectively. The stopping arrangement enables the vertical displacement mechanism 200*a*, 201*a* to be set in a compressed condition at the upper position of one of the first and second switch blades, such that play is reduced and a more robust and reliable support is provided to the switch blades. The compressed condition may be accomplished by controlling the actuator 176 to exert a pressing force on the lower wedges 211*a*.

Lateral support may be provided to the displacement mechanism 200*a*, 201*a* by placing each displacement mechanism 200*a*, 201*a* side by side with the longitudinal side walls 162*a*. Additional lateral support from the inside of the internal space 163*a* may be provided by having parts of the first frame 160*a* provide the necessary lateral support, for example by means of stationary casted concrete support structures 304*a*. Alternatively, or in combination with stationary concrete support structures, detachable lateral support may be provided, for example by means of support members secured to internal surface of the space 163*a* or support members pressing the first and second displacement mechanisms 200*a*, 201*a* apart, or the like.

Railway wheels 409, 411 and a common axle 413 of a railway car are illustrated in FIG. 4 in engagement with the first and second outer rails 111, 112, as well as the first switch blade 141. In the illustrated switching mode the second switch blade 142 is vertically displaced downwardly a distance 310 well beyond the depth 410 of the flange 412 of the right wheel 411, and the switch interconnects the first and third pair 110, 130 of running rails.

As mentioned above, the first frame 160*a* is typically made out of concrete. In the shown example embodiments the first frame 160*a* is provided with a heating mechanism adapted to heat the frame 16. An insulating cover 421*a* is also provided on the example embodiment of FIG. 4 for improving the heating properties of the switch mechanism and for covering the displacement mechanisms. The insulating cover 421*a* may be located on the metal channel 307*a*, or the first and second intermediate support members 213*a*, 214*a*. An insulating layer 422*a* is provided on the outside of the frame 160, in particular on the outside of the side walls 162*a*, 164*a* and on the insulating cover 421*a*.

The overall dimensions and scale of the first frame 160*a* is not correctly illustrated in FIG. 4, which is exaggerated in some aspects for improving the readability and understanding of the invention. For example, the required vertical motion of the switch blades 141, 142 is likely relatively small, maybe about 100 millimetres at switching point and about 50 millimetres at about distance D3. The wheel flanges are generally no allowed to grow beyond about 45 millimetres. The height of the first frame 160*a* may consequently be relatively low, such that distance D5 in FIG. 4 is in the range of 200-1000 millimetres, specifically in the range of 200-700 millimetres. The width D4 of the first frame 160*a* is general larger than the for example standard European gauge of 1435 mm. The width D4 will therefore in most installations be must larger than the height D5.

Figure 5:
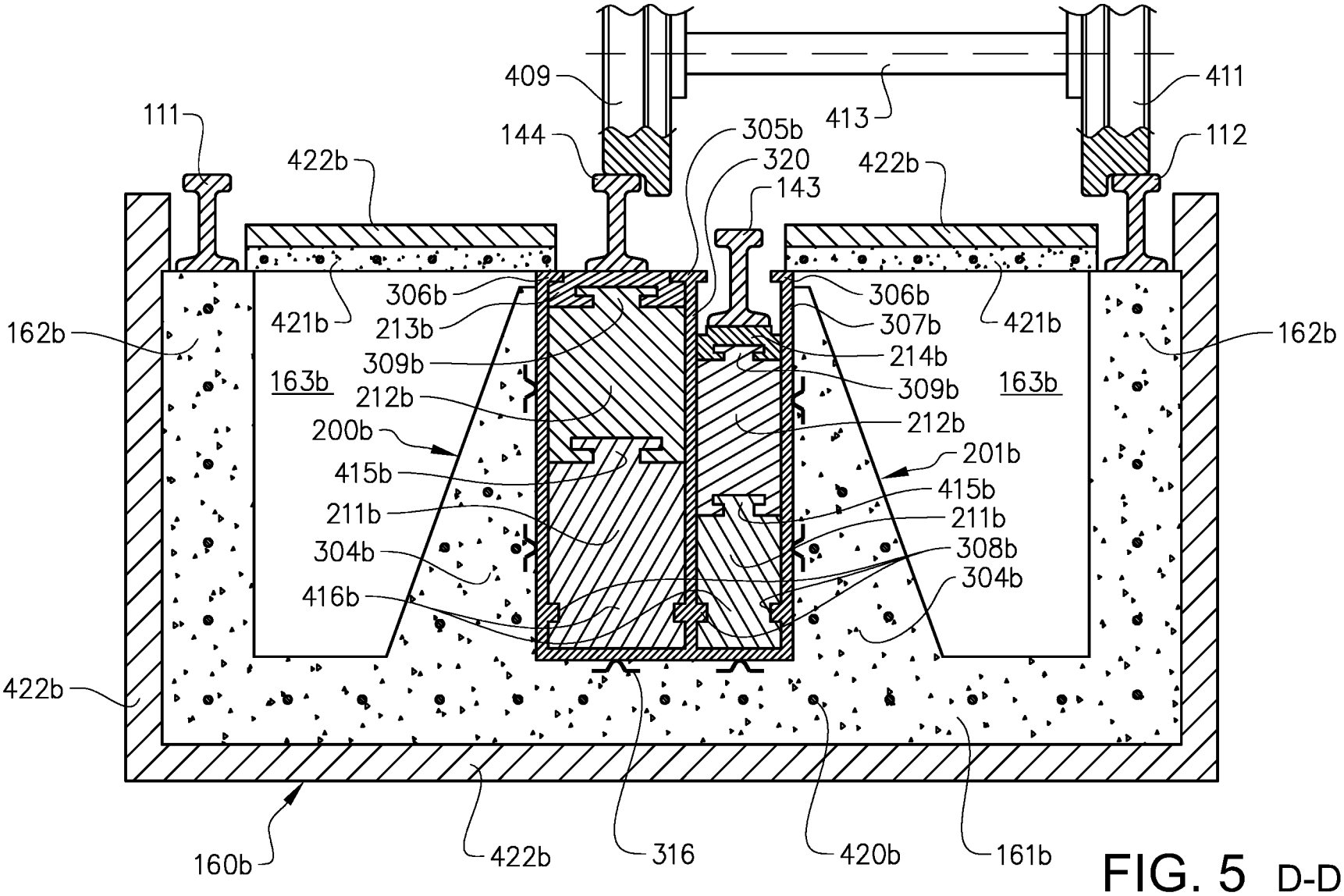
FIG. 5 shows a schematic cross-sectional cut along line D-D in FIG. 1.

FIG. 5 schematically shows a cross-sectional cut through the switch mechanism 100 at cut D-D in FIG. 1, i.e. through the switch frog 150. The first rail segment 144 is positioned in the upper position and the second rail segment 143 is positioned in the lower position. In FIG. 5, the second frame 160*b* is shown having the bottom 161*b* and the longitudinal side walls 162*b*. It can be clearly seen that the first and second outer rails 111, 112 are located on top of the longitudinal side walls 162*b*.

Essentially all aspects of the first and second displacement mechanisms 200*b*, 201*b* and the second frame 160*b* shown in FIG. 5 corresponds exactly to the first and second displacement mechanisms 200*a*, 201*a* and the first frame 160*a* previously described in relation to FIG. 4, and reference is made to the previous description relating to these aspects. This concerns in particular the design, arrangement and/or functionality of the first and second displacement mechanisms 200*b*, 201*b* and their wedges 211*b*, 212*b* and intermediate support members 213*b*, 214*b*, One difference is that the first and second displacement mechanisms 200*b*, 201*b* are located closed to each other such that a single metal channel member can be used for the displacement mechanisms 200*b*, 201*b* of both the first and second rail segments 144, 143. The single metal channel member will thus include two metal channels, each having a single displacement mechanism 200*b*, 201*b* therein. In the example embodiment of FIG. 5, the single metal channel member is designed a common wall 320, which defines one channel on each side thereof. The first and second displacement mechanisms 200*b*, 201*b* are thus sharing a common wall 320.

Another difference is the location of the first and second displacement mechanisms 200*b*, 201*b* within the space 163*b* of the second frame 160*b*. In FIG. 5, the first and second displacement mechanisms 200*b*, 201*b* are located essentially in a centre region of the internal space 163*b*. Consequently, lateral support is required from both lateral sides thereof. In the example of FIG. 5, lateral support is provided to the displacement mechanism 200*b*, 201*b* by having parts of the second frame 160*b* providing the necessary lateral support, i.e. in the form of stationary casted concrete support structures 304*b*. Alternatively, or in combination with stationary concrete support structures, detachable lateral support may be provided, for example by means of support members secured to internal surface of the space 163*b* or support members contacting the outer walls of the single metal channel member and the inner surface of the longitudinal side walls 162*b*, or the like.

At least one insulating cover 421*b*, and preferably at least two insulating covers 421*b* are provided to avoid snow and ice from entering into the internal space 163*b* of the second frame, as well as preventing heat from leaving the second frame 160*b*.

As discussed previously, the longitudinal orientation of each the displacement mechanism 200*b*, 201*b* of the switch frog does not have to be parallel with the longitudinal direction L, as illustrated in FIG. 1, and may be varied a certain extent. In the shown example the lower wedges 211*b* of both the displacement mechanism 200*b*, 201*b* are arranged to displace of in the longitudinal direction L. However, the first and second displacement mechanism 200*b*, 201*b* of the second frame 160*b* may alternatively have non-parallel orientation. For example, according to an advantageous alternative arrangement of the first and second displacement mechanism 200*b*, 201*b*, the second displacement mechanism 201*b* may remain arranged essentially in the longitudinal direction L of the switch mechanism 100 because that corresponds to the direction of the second rail segment 143, and the first displacement mechanism 200*b* may be oriented in an angle corresponding to the orientation angle of the first rail segment 144 of the switch frog 150.

Figure 6:
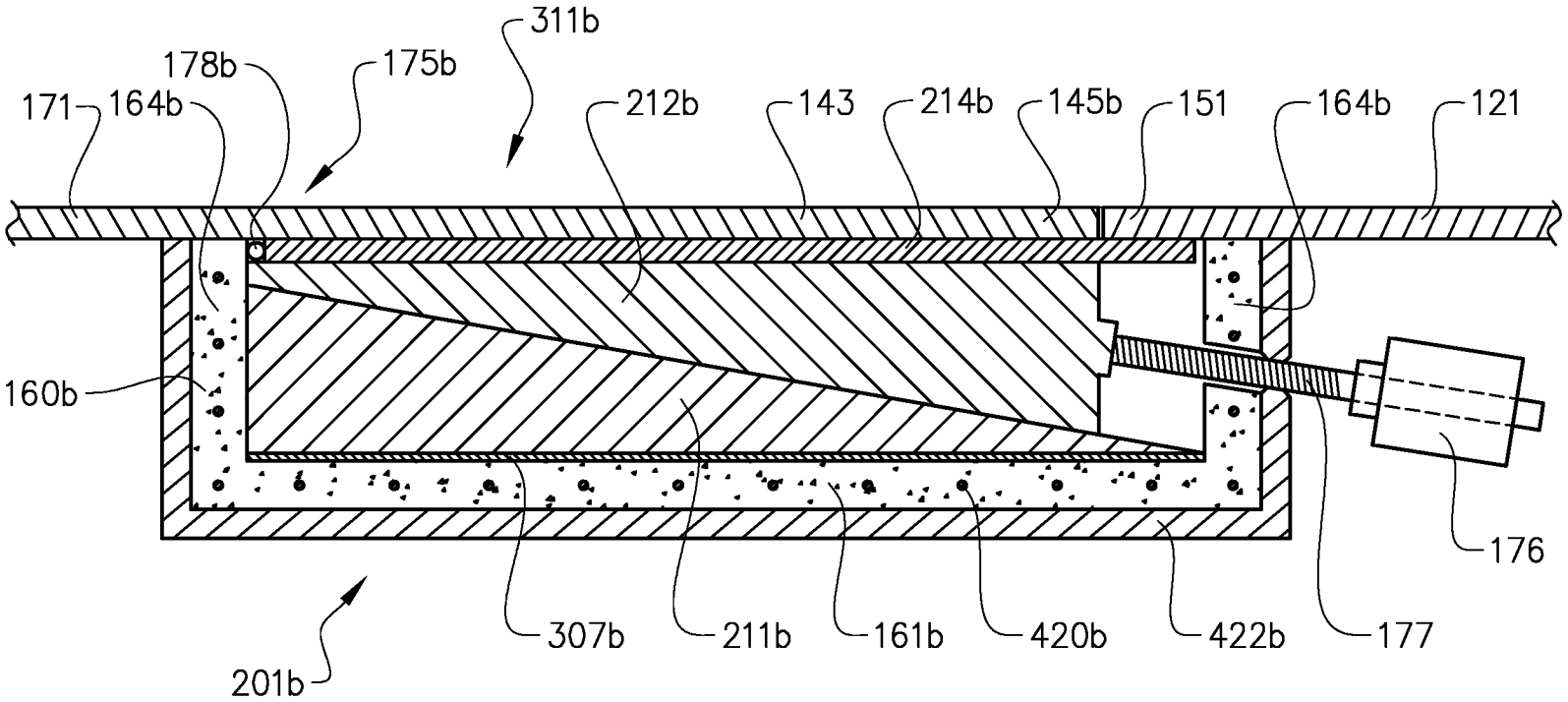
FIG. 6 shows a schematic cross-sectional cut along line C-C in FIG. 1 but with an alternative design of the displacement mechanism.

FIG. 6 schematically shows a cross-sectional cut through the switch mechanism 100 at cut C-C in FIG. 1 with the second rail segment 143 in an upper position, and with alternative embodiment of the second displacement mechanism 201*b*. In this alternative embodiment a single pair of cooperating wedges 311*b* is used for providing the required vertical displacement of the second rail segment 143. A single upper wedge 212*b* is thus adapted to engage a single lower wedge 211*b*, and the wedge inclination is constant over the entire working length of the displacement mechanism 201*b*.

The alternative embodiment is also different in that the upper wedge 212*b* is longitudinally displaceable while the lower wedge 211*b* is stationary. This allows for example making the lower wedge integral with the second frame 160*b*. Alternatively, the lower stationary wedge 211*b* may be made of metal, such as steel or aluminium.

Both the upper and lower wedge 212*b*, 212*a* are preferably extending over the entire length, or at least a substantial length, of the second rail segment 143 for providing vertical support to the second rail segment 143 along the entire, or at least substantial length thereof. The switch frog rail segments 144, 143 will carry the entire load exerted by a railway wheel passing the rail segment 144, 143 all the way to the switch points 145*b*, 146*b* of the rail segments 144, 143, thereby placing extra high demand on vertical support in the upper position. The vertical support requirement of the switch blades 141, 142 are less demanding because the switch blades do not carry any vertical load at the switch points 145*a*, 146*a* of the switch blades 141, 142 in the upper position, but merely act to steer the railway wheel towards the desired direction A, B. First when the railway wheel leaves the first or second outer rail 111, 112 will the switch blade 141, 142 carry the entire load exerted by a railway wheel passing the switch blade 141, 142.

The relative displacement of at least one wedge is provided by means of an actuator acting on a single wedge of the at least one of the upper and the lower wedge. A single or multiple actuators may be provided for each displacement mechanism.

Alternatively, a single actuator may be provided for two displacement mechanisms. This may for example be realised by providing each displacement mechanism with a threaded actuating mechanism and a worm gear coupled to said threaded actuating mechanism for controlling the longitudinal displacement of at least one wedge, as well as drivingly connecting both worm gears to a single electrical motor. This arrangement may further have the advantage of automatically controlling the mutually exclusive position of the switch blades or rail segments simply be having the worm gears configured to operate in different directions for the same rotational input direction from the motor. This arrangement would thus ensure that only a single switch blade or single rail segment is located in the upper position at any time, such that the risk for conflicting switching occurs.

Lubrication may be provided if sliding contact is used for the relative displacement. A centralised lubrication system with a single lubrication pump may be used for multiple displacement mechanisms 200*a*, 201*a*, 200*b*, 201*b*. In FIGS. 2-4 a pneumatic or hydraulic piston is shown implemented as a reliable and tested solution for controlling the turnout. An alternative solution is shown in FIG. 6, where an electrical motor 176 and threaded rod 177 is arranged to control the vertical displacement.

The switch mechanism has been mainly described as having both vertically displaceable switch blades and switch frog rail segments. However, the invention is applicable also when applied solely to the switch blades or solely to the switch frog. A switch mechanism having switch blades and a stationary frog may preferably in certain applications, for example at locations where only low speed and/or infrequent driving occurs and the problems of reduced comfort and increased wear do not motivate the increased complexity of a switch frog compared with a stationary frog. In such installations, depending on the size, shape and form of the switch mechanism 100, the switch blades 141, 142 may extend more or less all the way to the switch frog 150.

The switch blades and switch frog rail segments have been mainly disclosed as relying on elastic deformation (bending) for accomplishing the desired vertical displacement during switching motion between an upper and lower position and oppositely. However, either the switch blades 141, 142 and/or the switch frog rail segments 144, 143 may alternatively be pivotally connected to respective stationary closure rail 170, 171 for enabling the desired vertical displacement of the switch blades and/or switch frog rail segments 144, 143 instead. Moreover, the switch blades 141, 142 may rely on elastic deformation whereas the switch frog rail segments 144, 143 rely on pivotal motion, and oppositely.

Figure 7:
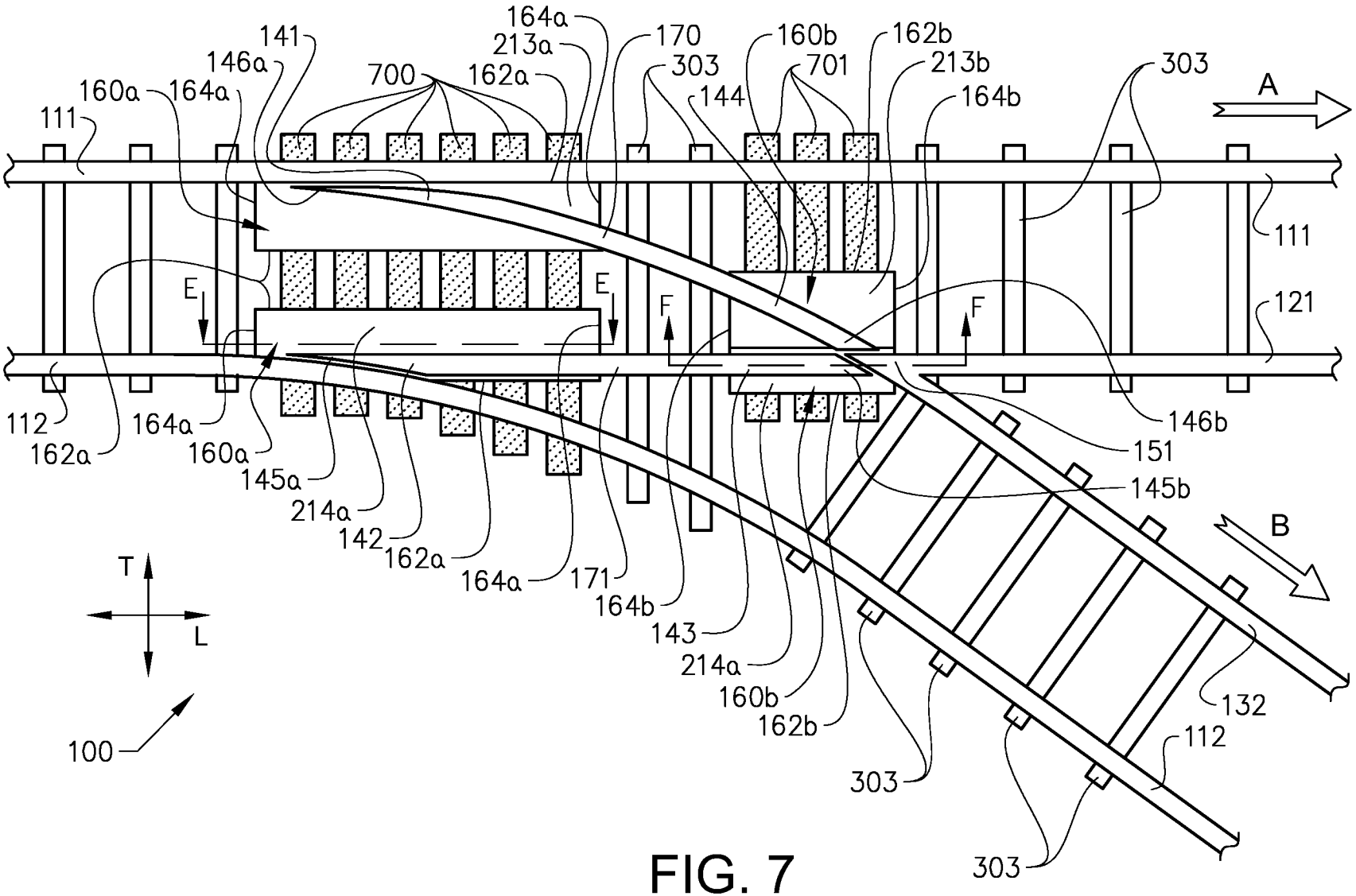
FIG. 7 shows a schematic top view of an alternative example embodiment of the switch mechanism.

According to an alternative example embodiment schematically shown in FIG. 7 the first frame 160*a* supporting the first and second switch blades 141, 142 may have a smaller and more compact design and supported by a plurality of sleepers 304*a*.

Similarly, as also showed in the alternative example embodiment of FIG. 7, the second frame 160*b* supporting the first and second vertically displaceable rail segments 144, 143 of the switch frog 150 may have a smaller and more compact design and being supported by a plurality of sleepers 304*b*. The sleepers 304*a*, 304*b* may be conventional sleepers, such as for example made of wood or concrete.

The small version of the first and second frames 160*a*, 160*b* may have relatively thin side walls, for example in the range of 10-200 millimetres, specifically in the range of 20-150 millimetres, and more specifically 25-100 millimetres. The first and second frames 160*a*, 160*b* may receive lateral and longitudinal support from the sleepers 304*a*, 304*b* by means a robust and strong connection between the first and second frames and the underlying sleepers 304*a*, 304*b*. The connection may for example be realised by means of threaded members, brackets, or the like, that clamp the first and second frames 160*a*, 160*b* to the underlying sleepers 304*a*, 304*b*. The sleepers 304*a*, 304*b* may for example be provided with one or two recesses in the upper surfaces for receiving the first and second frames, respectively. The one or two recesses may be designed to provide the first and second frames with lateral support via lateral walls of the recesses.

The sleepers 304*a*, 304*b* may further be provided with raised portions at one or both ends of the sleepers 304*a*, 304*b* for providing vertical support to the first and a second outer rails 111, 112, that are located outside of the first and second frames 160*a*, 160*b*.

The smaller and more compact design of the first and second frames 160*a*, 160*b* may for example be designed to receive support from the underlying sleepers 304*a*, 304*b* at regularly spaced apart locations along the longitudinal length of the rails, i.e. at those locations where a sleeper 304*a*, 304*b* is available.

The first and second frames 160*a*, 160*b* comprises a bottom wall 161*a*, 161*b*, two opposite transverse side walls 164*a*, 164*b* and two opposite longitudinal side walls 162*a*, 162*b*. The closed design of the frame 160*a*, 160*b* provides protection of the displacement mechanisms 200*b*, 201*b* located within the frame against snow, dirt and animals, etc.

The frame 160*a* 160*b* may be made of concrete and/or metal material. An electrical heating mechanism, such as a thermo-resistive conductor, may be installed at a suitable location in or on one or more walls of the frame, and/or within the frame.

The intermediate support members 213*b*, 214*b* of the first and second rail segments 144, 143 are located on the top side of the frame 160*a*, 160*b*. The intermediate support members 213*b*, 214*b* are preferably dimensioned to completely cover the opening in the top of the frame, such that snow, dirt and animals are prevented from entering into the displacement mechanisms 200*b*, 201*b*.

The intermediate support members 213*b*, 214*b* of the first and second rail segments 144, 143 are individually vertically displaceable in order to establish a vertical switch movement of the first and second rail segments 144, 143. The first and second rail segments 144, 143 are secured to the upper side of the intermediate support members 213*b*, 214*b* in any suitable way, such as be means of conventional clamping or welding of the first and second rail segments 144, 143 to the upper side of the intermediate support members 213*b*, 214*b*.

The vertical switch movement of the first and second rail segments 144, 143 are controlled by the displacement mechanisms 200*b*, 201*b*, which is located in the frame 160*a*, 160*b* and in operating connection with the bottom 161*a*, 161*b* of the frame and the underside of the intermediate support members 213*b*, 214*b*.

The displacement mechanisms 200*b*, 201*b* of the frame of the switch frog 150 may be powered by any type of suitable actuator 176. In the illustrated example of FIG. 8 the actuator 176 comprises two electrical motors, each of which controls the motion of an individual displacement mechanism 200*b*, 201*b* via a gear worm. One electrical motor is provided for each displacement mechanism 200*b*, 201*b*. A fluid powered actuator may alternatively be used.

Figure 8:
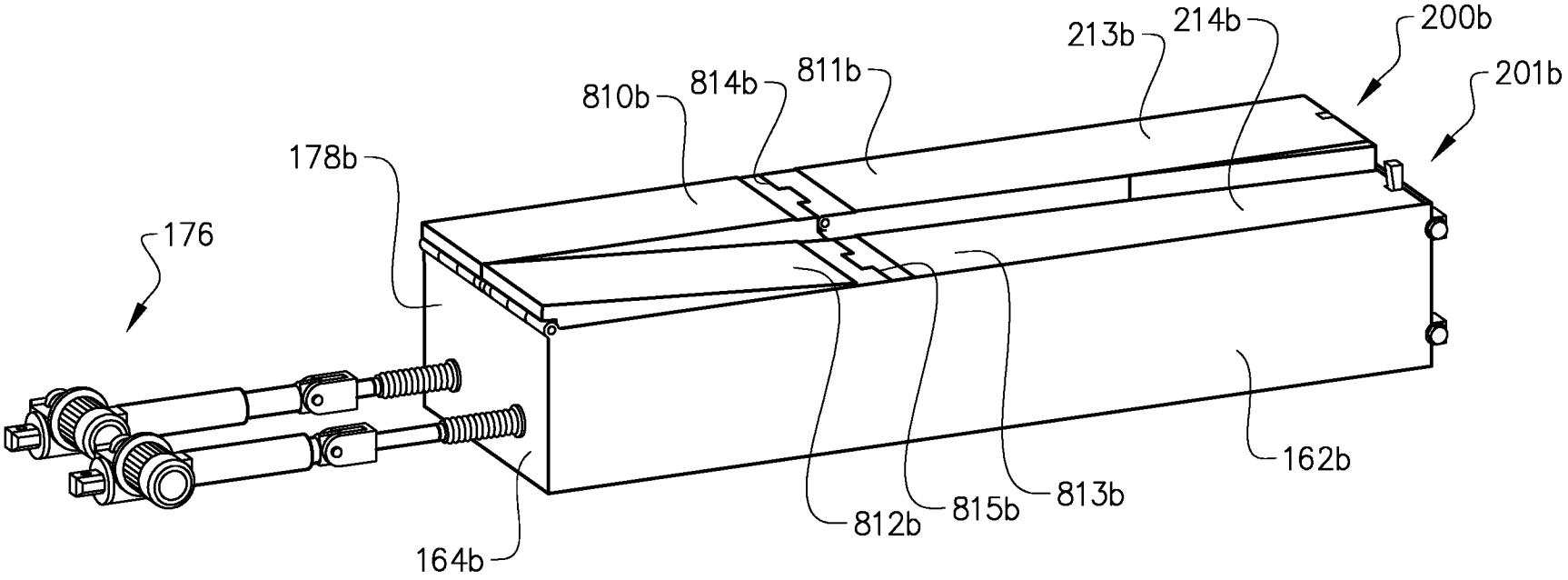
FIG. 8 shows a perspective view of a frame including a displacement mechanism for switch frog rail segments.

In the disclosed example embodiment of FIG. 8 each intermediate support member 213*b*, 214*b* of the first and second rail segments 144, 143 comprises a first part 810*b*, 812*b* and a second part 811*b*, 813*b*. This design is more in detail disclosed with reference to FIGS. 9*a* and 9*b*, which schematically illustrate a sectional view of the frame and displacement mechanisms 200*b*, 201*b* of the switch frog 150 along cut F-F in FIG. 7. FIG. 9*a* discloses a switching position for a railway car traveling in the second direction B, and FIG. 9*b* discloses a switching position for a railway car traveling in the first direction A.

Each part 810*b*, 811*b*, 812*b*, 813*b* defines a unique portion of the intermediate support members 213*b*, 214*b*. The first part 810*b*, 812*b* of each intermediate support member 213*b*, 214*b* is pivotally connected at or near a top of the transverse side wall 164*b* of the frame 160*b* at a first pivot point 178*b*. The first part 810*b* and second part 811*b* of the first intermediate support member 213*b* is additionally pivotally connected to each other at a second pivot joint 814*b*, and the first part 812*b* and second part 813*b* of the second intermediate support member 214*b* additionally pivotally connected to each other at a second pivot joint 815*b*.

The length L1 of the first part 810*b*, 812*b* of each intermediate support member 213*b*, 214*b* in the longitudinal direction L is typically less than the length L2 of the second part 811*b*, 813*b* of each intermediate support member 213*b*, 214*b* in the longitudinal direction L. The length L1 of the first part 810*b*, 812*b* may be in the range of 30%-90% of the length L2 of the second part 811*b*, 813*b*.

As described in detail above, the first and second rail segments 143, 144 may be made integral with the stationary closure rail 170, 171 and designed to rely on elastic deformation (bending) for accomplishing the desired vertical displacement during switching motion between an upper and lower position. Alternatively, the rail segments 144, 143 may be individual parts that are pivotally connected to respective stationary closure rail 170, 171 for enabling the desired vertical displacement of the segments 144, 143.

The first and second rail segments 144, 143 are secured to the upper side of the intermediate support members 213*b*, 214*b* in any suitable way, such as be means of conventional clamping or welding of the first and second rail segments 144, 143 to the upper side of the intermediate support members 213*b*, 214*b*.

The use of two pivot points 178*b*, 814*b*, 815*b* along the longitudinal length of each the intermediate support members 213*b*, 214*b* of the switch frog 150 enables the intermediate support members 213*b*, 214*b* to have a lowered vertical position over a relatively long distance. In fact, entire length L2 of the second part 811*b*, 813*b* of each intermediate support member 213*b*, 214*b* may be lowered to a position where the second part 811*b*, 813*b* is substantially parallel to the closure rail 170, 171. This design thus enables a relatively large vertical displacement over a relatively large length in the longitudinal direction.

Each displacement mechanism 200*b*, 201*b* of the switch frog 150 comprises two different components: a pull-down control member 900 and two pairs of cooperating wedges 311*b*, 312*b*.

The pull down control member 900 is located on the first part 810*b*, 812*b* of each intermediate support member 213*b*, 214*b* near the second pivot joint 814*b*, 815*b*. it may however alternatively be located on the second part 811*b*, 813*b* of each intermediate support member 213*b*, 214*b* near the second pivot joint 814*b*, 815*b*. The pull-down control member 900 comprises a track 904 formed in a base member 901 and a guide member in form of a shaft 903 penetrating the track 904 and arranged to follow the path of the track 904. The shaft 903 is attached to the lower side of the first part 810*b*, 812*b* of each intermediate support member 213*b*, 214*b* via a bracket 902.

The track has a horizontal path 904*a* that is arranged to provide vertical support to the first part 810*b*, 812*b* of each intermediate support member 213*b*, 214*b* in the vertically upper position via the shaft 903 and bracket 902. The track 904 also has an inclined path that cooperates with the shaft 903 to ensure that the bracket 902, and thus also the first and second parts 810*b*, 812*b*, 811*b* 813*b* of each intermediate support member 213*b*, 214*b*, are vertically displaced to lowered position upon longitudinal displacement of the base member 901 and shaft 903. The inclined path 904*b* may have an inclination 910 in the range of about 5-30 degrees from the horizontal direction.

By providing the pull down control member 900 with a shaft 903 that is arranged to slide in a track 904 with at least two individual directions two functionalities are obtained, namely a vertical support in the upper position and vertical displacement in the lower position. The pull down control member 900 may have many alternative designs. For example, the base member 901 may be fastened to the first part 810*b*, 812*b* or second part 811*b*, 813*b* of each intermediate support member 213*b*, 214*b* and the bracket 902 may be longitudinally displaced by the actuator 176. The pull down control member 900 may still more alternatively be designed as two cooperating wedges with cooperating grooves, similar to the wedges 211*b*, 212*b* and groove and tongue arrangement 415*a* of FIG. 5.

Each of the two pair of cooperating wedges 311*b*, 312*b* may have identical design, each comprising a lower wedge 211*b* and an upper wedge 212*b*. The lower wedges 211*b* are arranged to be displaced in a direction substantially parallel to a longitudinal direction of the rail segments 144, 143, or substantially parallel to the longitudinal direction L of the railway switch mechanism 100. The lower and upper wedge 211*b*, 212*b* of each pair of cooperating wedges are designed generate a vertical displacement of the upper wedge 212*b* upon substantially horizontal motion of one of the upper and lower wedges 212*b*, 211*b*.

According to the example embodiment of FIGS. 9*a* and 9*b* an upwardly facing sliding surface of the lower wedge 211*b* comprises a substantially horizontal surface segment 911*b* arranged neighbouring to an inclined sliding surface segment 912*b*. The angle of inclination 913 of the inclined sliding surface segment 912*b* may be in the range of 5-30 degrees. Moreover, the angle of inclination 913 of the inclined sliding surface segment may be substantially identical to the inclination 910 of the inclined path 904*b* of the track 904 formed in the base member 901. Thereby the second parts 811*b*, 813*b* of each intermediate support member 213*b*, 214*b* may be vertically displaced while keeping its angle of inclination unchanged. This may be deemed advantageous because it enables a sufficient vertical displacement of second parts 811*b*, 813*b* of each intermediate support member 213*b*, 214*b* in a compact package.

Each upper wedge 212*b* has a design that corresponds to the design of the lower wedge 211*b*. Each upper wedge 212*b* thus comprises a downwardly facing sliding surface comprising a substantially horizontal surface segment arranged neighbouring to an inclined sliding surface segment.

As shown in the example embodiment of FIGS. 9*a* and 9*b* the base member 901 and the lower wedges 211*b* of the second intermediate support member 214*b* are horizontally displaced by a single individual actuator 176. This is realised by means of longitudinally extending longitudinally slidable control member 915*b* that is drivingly connected to the single actuator 176, and by fastening the base member 901 and the lower wedges 211*b* of the second intermediate support member 214*b* to said control member 915*b*. The control member 915*b* may be a metal plate.

The control member 915*b* is secured against vertical displacement. This is necessary for avoiding that the control member 915*b* displaces upwardly upon horizontal displacement of the control member 915*b* that is intended to result in a lowering motion of the second intermediate support member 214*b*. Vertical securing of the control member 915*b* while allowing longitudinal sliding motion may be realised by means of a locking arrangement 416*b*, which for example may comprise any suitable interlocking groove and tongue arrangement. The locking arrangement 416*b* may be provided between the control member 915*b* and an underlying support structure, such as the bottom 161*b* of the frame 160*b* as shown in FIGS. 9*a* and 9*b*, and/or between the control member 915*b* and a longitudinal side wall 162*b* of the frame 160*b*, or the like.

The first and second displacement mechanisms 200*b*, 201*b* of the switch frog 150, including the pull down control member 900, the cooperating pair of wedges 311*b*, 312*b*, the control member 915*b* and the actuator may have a substantially identical design.

In FIG. 9*a* the first intermediate support member 213*b* is located in an upper position ready for providing vertical support to the first rail segment 144 and to substantially minimize any switch gap between the first rail segment 144 and the frog tip 151, and the second intermediate support member 214*b* is vertically displaced to a lower position, such that a railway wheel of a railway car traveling along the second direction B may pass over the second rail segment 143.

In FIG. 9*b* the second intermediate support member 214*b* is located in an upper position ready for providing vertical support to the second rail segment 143 and to substantially minimize any switch gap between the second rail segment 143 and the frog tip 151, and the first intermediate support member 213*b* is vertically displaced to a lower position, such that a railway wheel of a railway car traveling along the first direction A may pass over the first rail segment 144.

The design principles of the example embodiment of the displacement mechanisms 200*b*, 201*b* of the first and second vertically displaceable rail segments 144, 143 shown in FIG. 8, 9*a*, 9*b* may be applied also for displacement mechanisms 200*a*, 201*a* of the first and second vertically displaceable switch blades 141, 142. An example embodiment of the first and second vertically displaceable switch blades 141, 142 applying said design principles is schematically shown in FIG. 10.

The sectional view of FIG. 10 corresponds in principle to the cut E-E in FIG. 7 but with a significantly extended version of the second displacement mechanisms 201*a*. Such a longitudinally extended version of the railway switch mechanism 100 is required for high speed installations. The first displacement mechanisms 200*a* has substantially an identical design as the second displacement mechanisms 201*a* and will therefore not be described in detail herein.

The second displacement mechanisms 201*a* of the first and second switch blade 142 may be installed in an elongated frame 160*a* having a bottom 161*a*, two opposite transverse side walls 164*a* and two opposite longitudinal side walls 162*a*. Most parts of the second displacement mechanism 201*a* of the second switch blade 142 is substantially identical to the second displacement mechanism 201*b* of the switch frog 150 and will not be repeated again.

The major difference between second displacement mechanism 201*a* of the second switch blade 142 shown in FIG. 10 and the second displacement mechanism 201*b* of the switch frog 150 shown in FIGS. 9*a* and 9*b* is the significantly larger total length L3 of the second displacement mechanism 201*a*. As a result, more pairs of cooperating wedges are necessary for distributing the load from a train set to the sleepers 700. For example, about one pair of cooperating wedges may be located above each sleeper 700, except for locations of the actuator 176 and pull down control members 900, 950.

The second intermediate support member 214*a* comprises a first part 812*a* and a second part 813*a*. Four pairs of cooperating wedges 340*a*, 341*a*, 342*a*, 343*a* are distributed under the first part 812*a*. Since the first part 812*a* pivots around a pivotal connection 178*a* and the second pivot joint 815*a* is arranged to be vertically displaced the angle of inclination $\alpha 1$, $\alpha 2$, $\alpha 3$, $\alpha 4$ of the inclined sliding surface segment of each pair of cooperating wedges 340*a*, 341*a*, 342*a*, 343*a* gradually increases for each pair of cooperating wedges that is located closer to the second pivot joint 815*a*.

A plurality of substantially identical pairs of cooperating wedges 311*a*, 312*a*, 313*a*, 314*a* are distributed under the second part 813*a* of the second intermediate support member 214*a*. All of them may have the same angle of inclination 913 of the inclined sliding surface.

The longer total length L3 of the second displacement mechanism 201*a* may require that the second part 813*a* of the second intermediate support member 214*a* is provided with one or more additional pull down control members 950 for ensuring that the second part 813*a* actually displaces to the lower position when desired. Neighbouring pull down control members 900, 950 may for example have about 3-10 pairs of cooperating wedges, specifically about 4-6 pairs of cooperating wedges, located between them. The number of pairs of cooperating wedges of the first and second parts 812*a*, 813*a*, 812*b*, 813*b* of the first and second intermediate support members 213*a*, 213*b*, 214*a*, 214*b* may be varied according to the specific circumstance. A design comprising only pull down control members 900, 950 and no pairs of cooperating wedges is possible. One or more pull down control members 900, 950 may also be used together with a rigid, single-piece, first and second intermediate support member 213*a*, 213*b*, 214*a*, 214*b*. In such an embodiment the inclination 910 of the inclined path 904*b* may have to be selected individual for each pull down control member 900, 950 for adapting the vertical displacement to the distance from the single pivot point 178*a*, 178*b* of the first and second intermediate support member 213*a*, 213*b*, 214*a*, 214*b*.

According to a further alternative embodiment (not shown) the displacement mechanism 200*a*, 201*a*, 200*b*, 201*b* of the first and second switch blades 141, 142 and/or of the first and second rail segments 143, 144 may comprise a single wedge instead of a pair of cooperating wedges. The single wedge may be fastened to the underlying support structure, such as the control member 915*a*, 915*b*, or with the intermediate support member 213*a*, 214*a*, 213*b*, 214*b*. The single wedge may comprise an inclined sliding surface segment 912*b* and a neighbouring substantially horizontal surface segment 911*b*. The single wedge may furthermore be arranged to cooperate with an oppositely located corresponding member, such as a member having a substantially horizontal support surface. The horizontal support surface of the corresponding member enables a sufficiently large surface area for avoiding excessive load pressure. Moreover, the horizontal support surface of the corresponding member allows sliding along the inclined sliding surface segment 912*b*.

The term elastic deformation means deformation within a range that ends when the material reaches its yield strength. At this point plastic deformation begins. Elastic deformation is reversible, which means that an object will return to its original shape, but plastic deformation is irreversible.

The present invention has been disclosed and illustrated mainly in terms of standard right-hand diverging railway turnout but also other railway switch embodiments are included in the present invention, such as standard left-hand switches, single or double inside or outside slip switch, three way switch, stub switch, wye switch (Y points), or the like.

The displacement mechanism of the invention as disclosed in FIGS. 1-6 comprises one or more pairs of cooperating wedges for accomplishing the desired vertical displacement of the switch blades and switch frog rail segments. However, alternative displacement mechanisms may be used, depending in the specific circumstances. For example, a single longitudinally displaceable wedge, a single stationary wedge in combination with one or more longitudinally displaceable spacers, or the like may alternatively be adopted.

Moreover, in case the switch blades and/or switch frog rail segments are pivotally connected to the closure rails at a hinge joint, the switch blades and/or rail segments do not have to be elastically bendable in the vertical direction, such that they may be reinforced to withstand the load of the railway car while being supported only at the hinge joint and one additional location. This would enable use of a local positioned vertical displacement mechanism, such as a vertically arranged hydraulic cylinder, a vertically arranged threaded rod driving connected to an electrical motor, or the like.

It should be noted that the overall dimensions and scale of the drawings are not intended to correspond to a final physical installation of the switch mechanism and its parts, but merely a schematic illustration of the invention. For example, the switch gaps at the switch blades and switch frog rail segments are shown exaggerated for improving the readability and understanding of the invention.

The present invention may be embodied in other specific forms without departing from its spirit or essential characteristics. It is appreciated that various features of the above-described examples can be mixed and matched to form a variety of other alternatives. As such, the described embodiments are to be considered in all respects only as illustrative and not restrictive. The scope of the invention is, therefore, indicated by the appended claims rather than by the foregoing description. All changes that come within the meaning and range of equivalency of the claims are to be included within their scope.

Reference signs mentioned in the claims should not be seen as limiting the extent of the matter protected by the claims, and their sole function is to make claims easier to understand.

The invention claimed is:

1. Railway switch mechanism comprising a first and a second switch blade, wherein a switch point of each of the first and the second switch blades is vertically displaceable by means of a displacement mechanism in order to establish a switch movement in the respective switch point, wherein each respective displacement mechanism comprises at least one pair of cooperating wedges having a lower wedge and an upper wedge, at least one wedge of the at least one pair of cooperating wedges is arranged to be displaced in a direction substantially parallel to a longitudinal direction of the switch blade or parallel with a longitudinal direction (L) of the switch mechanism, and the switch blades are elastically deformable in the vertical direction or pivotally connected by hinged joints to first and second closure rails respectively for enabling the vertical displacement of the switch blades.

2. A switch mechanism according to claim 1, wherein each displacement mechanism of the first and the second switch blades is located in a frame that has a bottom, two transverse side walls and two longitudinal side walls enclosing the displacement mechanism.

3. A switch mechanism according to claim 1, wherein the first and second switch blades are fastened to intermediate support members respectively, and the displacement mechanisms are connected to the intermediate support members and arranged for displacing the intermediate support members in the vertical direction.

4. A switch mechanism according to claim 3, wherein each intermediate support member closes the upper surface of an internal space defined by the frame.

5. A switch mechanism according to claim 3, wherein each intermediate support member comprises a first part and a second part, wherein one end of the first part is pivotally connected to an upper side of a transverse side wall of the frame at a first pivot point and the opposite end of the first part is pivotally connected to the second part at a second pivot joint.

6. A switch mechanism according to claim 5, wherein the displacement mechanism controlling the motion of the first part comprises a plurality of longitudinally spaced apart pair of cooperating wedges, each of which having a unique angle of inclination.

7. A switch mechanism according to claim 5, wherein the displacement mechanism controlling the motion of the second part comprises a plurality of longitudinally spaced apart pair of cooperating wedges having the same angle of inclination.

8. Railway switch mechanism comprising a switch frog, wherein the switch frog comprises first and second vertically displaceable rail segments in order to establish a switch movement at the switch frog, wherein each switch frog rail segment is provided with a respective displacement mechanism by means of which at least a portion of the first and second switch frog rail segments can be displaced in a vertical direction to at least an upper and a lower position, wherein each respective displacement mechanism comprises at least one pair of cooperating wedges having a lower wedge and an upper wedge, wherein the at least one wedge of the at least one pair of cooperating wedges is arranged to be displaced in a longitudinal direction (L) of the switch mechanism, or in a direction substantially parallel to a longitudinal direction of the switch frog rail segment, respectively.

9. Railway switch mechanism comprising:

first and second switch blades and a switch frog, wherein:

a switch point of each of the first and the second switch blades is vertically displaceable in order to establish a switch movement in the respective switch point;

the switch frog comprises first and second vertically displaceable rail segments in order to establish a switch movement at the switch frog;

each railway switch blade and each switch frog rail segment is provided with a respective displacement mechanism;

each respective displacement mechanism comprises at least one pair of cooperating wedges having a lower wedge and an upper wedge;

said at least one pair of cooperating wedges is arranged such that relative displacement between the lower and upper wedges causes a vertical movement of at least the upper wedge; and at least one wedge of the at least one pair of cooperating wedges is arranged to be displaced in a longitudinal direction (L) of the switch mechanism, or in a direction substantially parallel to a longitudinal direction of the switch blade or substantially parallel to a longitudinal direction of the switch frog rail segment, respectively.

10. A switch mechanism according to claim 9, wherein the switch mechanism is suitable for switching railway wheels of a railway car traveling on a railway diverging in to a first and a second direction (A, B), and the switch mechanism comprises a first pair of running rails diverging into a second and third pair of running rails, wherein the first pair of running rails comprises a first and a second outer rail and the switch frog diverges into a first and a second inner rail, the second pair of running rails comprises the first outer rail and the first inner rail;

the third pair of running rails comprises the second outer rail and the second inner rail;

the first switch blade extend at least partly between the first outer rail and the switch frog; and the second switch blade extend at least partly between the second outer rail and the switch frog.

11. A switch mechanism according to claim 9, wherein at least one pair of cooperating wedges is connected with a switch blade or a switch frog rail segment such that the vertical movement of at least the upper wedge is transmitted to a vertical movement of at least a portion of the first and second switch blade or at least a portion of the first and second switch frog rail segment.

12. A switch mechanism according to claim 9, wherein relative displacement between the lower and upper wedges is provided by means of an actuator acting on the at least one wedge or on at least one of the upper and the lower wedges.

13. A switch mechanism according to claim 9, wherein each displacement mechanism of the railway switch blades and/or switch frog rail segments comprises a plurality of pairs of cooperating wedges spread over at least a portion of the first and second switch blades and/or a portion of the first and second switch frog rail segments.

14. A switch mechanism according to claim 9, wherein at least two of the plurality of pairs of cooperating wedges of each displacement mechanism of the railway switch blades and/or switch frog rail segments are provided with different wedge inclinations, such that the same relative displacement in a horizontal direction of the two different pairs of cooperating wedges give different magnitudes of movement in vertical direction (V) of the respective pair of cooperating wedges.

15. A switch mechanism according to claim 9, wherein the switch frog comprises a frog tip, and the first and second vertically displaceable rail segments are arranged to selectively establish a substantially continuous rail path from the first and second switch blade to the frog tip respectively.

16. A switch mechanism according to claim 9, wherein the displacement mechanisms of the railway switch blades are positively secured to an underside support structure of the displacement mechanisms and to the switch blades, and/or the displacement mechanisms of the switch frog rail segments are positively secured to an underside support structure of the displacement mechanisms and to the switch frog rail segments.

17. A switch mechanism according to claim 9, wherein the switch blades and/or the switch frog rail segments are deformed elastically in the vertical direction for enabling the desired vertical displacement thereof.

18. A switch mechanism according to claim 9, wherein the switch blades and/or the switch frog rail segments are pivotally connected by hinged joints to first and second closure rails respectively for enabling the desired vertical displacement of the switch blades and/or the switch frog rail segments.

19. A switch mechanism according to claim 9, wherein the switch mechanism is arranged at least partly on at least one frame provided with a bottom and at least two side walls extending therefrom, a first outer rail and second outer rail are arranged on said at least two side walls, and the displacement mechanisms are located in least partly within a space defined by the bottom and the at least two side walls.

20. A switch mechanism according to claim 19, wherein the switch mechanism is arranged at least partly on a first frame arranged at least partly surrounding the first and second switch blades, and a second frame arranged at least partly surrounding the switch frog.

21. A switch mechanism according to claim 20, wherein the first frame additionally comprises a lateral side wall adjacent a heel end of the switch blades, the lateral side wall is arranged to provide support for enabling the desired vertical displacement of the switch blades, the second frame additionally comprises a lateral side wall adjacent a heel end of the switch frog rail segments, and the lateral side wall (164*b*) is arranged to provide support for enabling the desired vertical displacement of the switch frog rail segments.

22. A switch mechanism according to claim 9, wherein a cover is provided on top of at least one of the first and second frames for at least partly covering the displacement mechanisms.

23. A switch mechanism according to claim 9, wherein the at least one frame is made of concrete and is provided with an electrical heating mechanism.

24. A switch mechanism according to claim 9, wherein the at least one frame is arranged to provide lateral support to the at least one displacement mechanism.

25. A switch mechanism according to claim 9, wherein at least one displacement mechanism is located at least partly in a metal channel providing lateral support to the at least one displacement mechanism.

26. A switch mechanism according to claim 25, wherein the metal channel is located side by side with a side wall of the at least one frame.

27. A switch mechanism according to claim 25, wherein the metal channel comprises a stopping arrangement for providing a limit to the vertical displacement of the displacement mechanism in an upward direction.

28. A switch mechanism according to claim 27, wherein the stopping arrangement comprises at least one abutment member projecting into the metal channel and arranged to come into engagement with the displacement mechanism or an intermediate support member at the upper position of one of the first and second switch blades or first and second rail segments.

29. A switch mechanism according to claim 9, wherein at least one displacement mechanism of the first and the second switch blades and of first and second rail segments is located in a frame that has a bottom, two transverse side walls and two longitudinal side walls enclosing the displacement mechanism.

30. A switch mechanism according to claim 29, wherein the frame is secured to a plurality of underlying sleepers.

31. A switch mechanism according to claim 30, wherein at least one of the sleepers that supports the frame also supports a first and/or a second outer rail of the railway switch mechanism.

32. A switch mechanism according to claim 9, wherein at least one of the first and second switch blades and the first and second rail segments are fastened to intermediate support members respectively, and the displacement mechanisms are connected to the intermediate support members and arranged for displacing the intermediate support members in the vertical direction.

33. A switch mechanism according to claim 32, wherein at least one of the intermediate support members closes the upper surface of an internal space defined by each frame.

34. A switch mechanism according to claim 32, wherein at least one of the intermediate support members comprises a first part and a second part, wherein one end of the first part is pivotally connected to an upper side of a transverse side wall of the frame at a first pivot point and the opposite end of the first part is pivotally connected to the second part at a second pivot joint.

35. A switch mechanism according to claim 32, wherein the displacement mechanism controlling the motion of the first part comprises a plurality of longitudinally spaced apart pair of cooperating wedges, each of which having a unique angle of inclination.

36. A switch mechanism according to claim 32, wherein the displacement mechanism controlling the motion of the second part is arranged to vertically displace the second part while maintaining its horizontal orientation fixed.

37. A switch mechanism according to claim 32, wherein the displacement mechanism controlling the motion of the second part comprises a plurality of longitudinally spaced apart pair of cooperating wedges having the same angle of inclination.

38. A switch mechanism according to claim 32, wherein the displacement mechanism comprises a pull-down control member, which is connected to an underlying support structure and the intermediate support member, wherein the pull-down control member comprises a track with an inclined path and a guide member arranged to be guided by the track.

39. A switch mechanism according to claim 9, wherein the displacement mechanism comprises a longitudinally extending longitudinally slidable control member drivingly connected to an actuator, wherein a wedge of the at least one pair of cooperating wedges is attached to the control member, and the control member is secured against vertical displacement.

40. Method for operating a railway switch mechanism according to claim 9, the method comprising establishing a switch movement of the first and the second switch blades by vertical displacement of a switch point of the first and second switch blade, respectively; and establishing a switch movement of the switch frog by vertical displacement of a first and second rail segments.

* * * * *